US007122768B2

(12) United States Patent
Imai et al.

(10) Patent No.: US 7,122,768 B2
(45) Date of Patent: Oct. 17, 2006

(54) HEATING ROLLER, IMAGE HEATING APPARATUS, AND IMAGE FORMING APPARATUS

(75) Inventors: Masaru Imai, Hirakata (JP); Masaaki Nakano, Shijonawate (JP); Syuuiti Watanabe, Yawata (JP); Keisuke Fujimoto, Hirakata (JP); Masaomi Inoue, Onojo (JP); Noboru Katakabe, Uji (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/472,410

(22) PCT Filed: Oct. 31, 2002

(86) PCT No.: PCT/JP02/11330

§ 371 (c)(1),
(2), (4) Date: Sep. 17, 2003

(87) PCT Pub. No.: WO03/039198

PCT Pub. Date: May 8, 2003

(65) Prior Publication Data

US 2004/0099650 A1 May 27, 2004

(30) Foreign Application Priority Data

Nov. 1, 2001 (JP) ..... 2001-336321
Nov. 14, 2001 (JP) ..... 2001-349188

(51) Int. Cl.
*H05B 6/14* (2006.01)
*G03G 15/20* (2006.01)

(52) U.S. Cl. ..... 219/619; 219/649; 399/328; 399/330

(58) Field of Classification Search ..... 219/619, 219/649; 399/328–338
See application file for complete search history.

(56) References Cited

U.S. PATENT DOCUMENTS 4,948,466 A * 8/1990 Jaakkola ..... 219/619
5,768,673 A 6/1998 Morigami
5,832,354 A * 11/1998 Kouno et al. ..... 399/330
5,862,445 A * 1/1999 Ogawa et al. ..... 399/329

(Continued)

FOREIGN PATENT DOCUMENTS

EP 0 957 412 11/1999

(Continued)

*Primary Examiner*—Philip H. Leung
(74) *Attorney, Agent, or Firm*—Hamre, Schumann, Mueller & Larson, P.C.

(57) ABSTRACT

A heating roller (21) includes a heat generating layer (22) that generates heat by electromagnetic induction, a heat insulating layer (23), and a supporting layer (24), which are provided inwardly in this order. The supporting layer (24) is formed of a material having a specific resistance of $1\times10^{-5}$ Ωm or higher. Therefore, even when the heat generating layer (22) has a thickness smaller than a skin depth, i.e. a thickness defined by a flow of an induction current, so that magnetic flux penetrates the heat generating layer (22) and even reaches the supporting layer (24), heat generation of the supporting layer (24) under an eddy current can be suppressed. Thus, the heat generating layer (22) can be decreased in thermal capacity, and heat generation of the supporting layer (24) is suppressed, so that only the heat generating layer (22) can be heated efficiently. As a result, a warm-up time can be reduced. Further, breakage by heat of, for example, bearings supporting the heating roller (21) can be prevented.

12 Claims, 11 Drawing Sheets

U.S. PATENT DOCUMENTS

| | | | | |
|---|---|---|---|---|
| 5,915,147 | A | 6/1999 | Kouno et al. | |
| 5,939,337 | A | 8/1999 | Hatakeyama et al. | |
| 6,021,303 | A | 2/2000 | Terada et al. | |
| 6,037,576 | A | 3/2000 | Okabayashi et al. | |
| 6,069,347 | A | 5/2000 | Genji et al. | |
| 6,175,713 | B1 * | 1/2001 | Uehara et al. | 219/619 |
| 6,453,144 | B1 | 9/2002 | Sato | |
| 6,605,802 | B1 | 8/2003 | Nagahira | 219/619 |
| 6,668,151 | B1 | 12/2003 | Uehara et al. | |
| 6,687,481 | B1 | 2/2004 | Watanabe et al. | |
| 6,810,230 | B1 | 10/2004 | Imai et al. | |

FOREIGN PATENT DOCUMENTS

| | | |
|---|---|---|
| EP | 1 174 774 | 1/2002 |
| JP | 08-16007 | 1/1996 |
| JP | 9-44015 | 2/1997 |
| JP | 9-80939 | 3/1997 |
| JP | 9-127810 | 5/1997 |
| JP | 10-48976 | 2/1998 |
| JP | 10-74007 | 3/1998 |
| JP | 10-74009 | 3/1998 |
| JP | 10-254263 | 9/1998 |
| JP | 10-319751 | 12/1998 |
| JP | 11-288190 | 10/1999 |
| JP | 2000-206814 | 7/2000 |
| JP | 2001-5315 | 1/2001 |
| JP | 2001-230064 | 8/2001 |
| JP | 2002-93566 | 3/2002 |

* cited by examiner

HEATING ROLLER, IMAGE HEATING APPARATUS, AND IMAGE FORMING APPARATUS

TECHNICAL FIELD

The present invention relates to a heating roller that is heated by an eddy current generated utilizing electromagnetic induction. Furthermore, the present invention relates to an image heating device that is used suitably as a fixing device for thermally fixing an unfixed image by heating in an image forming apparatus such as an electrophotographic apparatus and an electrostatic recording apparatus or the like. Moreover, the present invention relates to an image forming apparatus including such an image heating device.

BACKGROUND ART

Conventionally, as image heating devices typified by thermofixing devices, contact heating type devices such as of a roller heating type and a belt heating type have been in general use.

In recent years, in response to the demand for a reduction in power consumption and warm-up time, roller heating type and belt heating type devices employing an electromagnetic induction heating method have been proposed.

FIG. 14 shows an example of a conventional image heating device including a heating roller that is heated by electromagnetic induction (see, for example, JP11(1999)-288190 A).

In FIG. 14, reference numeral 820 denotes a heating roller including a supporting layer 824 made of metal, an elastic layer 823 that is formed from a heat-resistant foam rubber and molded integrally on an outer surface of the supporting layer 824, a heat generating layer 821 formed of a metallic tube, and a mold releasing layer 822 provided on an outer surface of the heat generating layer 821, which are provided outwardly in this order. Reference numeral 827 denotes a pressing roller that is formed from a heat-resistant resin and has the shape of a hollow cylinder. A ferrite core 826 wound with an excitation coil 825 is placed in an inner portion of the pressing roller 827. The ferrite core 826 applies pressure to the heating roller 820 through the pressing roller 827, and thus a nip part 829 is formed. While the heating roller 820 and the pressing roller 827 rotate in the respective directions indicated by arrows, a high-frequency current is fed through the excitation coil 825. This causes alternating magnetic fields H to be generated, so that the heat generating layer 821 of the heating roller 820 is heated rapidly by electromagnetic induction to a predetermined temperature. While predetermined heating is continued in this state, a recording material 840 is inserted into and passed through the nip part 829. Thus, toner images 842 formed on the recording material 840 are fixed on the recording material 840.

Furthermore, in addition to devices of the above-mentioned roller heating type using the heating roller 820 having the induction heat generating layer 821 as shown in FIG. 14, devices of the belt heating type using an endless belt including an induction heat generating layer have been proposed. FIG. 15 shows an example of a conventional image heating device using an endless heating belt that is heated by electromagnetic induction (see, for example, JP10(1998)-74007 A).

In FIG. 15, reference numeral 960 denotes a coil assembly as an excitation unit that generates a high-frequency magnetic field. Reference numeral 910 denotes a metal sleeve (heating belt) that generates heat under a high-frequency magnetic field generated by the coil assembly 960. The metal sleeve 910 is formed by coating a surface of an endless tube made from a thin layer of nickel or stainless with a fluorocarbon resin. An inner pressing roller 920 is inserted in an inner portion of the metal sleeve 910, and an outer pressing roller 930 is placed outside the metal sleeve 910. The outer pressing roller 930 is pressed against the inner pressing roller 920 such that the metal sleeve 910 is interposed between them, and thus a nip part 950 is formed. While the metal sleeve 910, the inner pressing roller 920, and the outer pressing roller 930 rotate in the respective directions indicated by arrows, a high-frequency current is fed through the coil assembly 960. Thus, the metal sleeve 910 is heated rapidly by electromagnetic induction to a predetermined temperature. While predetermined heating is continued in this state, a recording material 940 is inserted into and passed through the nip part 950. Thus, a toner image formed on the recording material 940 is fixed on the recording material 940.

In each of the image heating devices employing the electromagnetic induction heating method, which are shown in FIGS. 14 and 15, a further reduction in warm-up time requires a reduction in thermal capacity of the heat generating layer heated by induction heating, i.e. a reduction in thickness of the heat generating layer.

However, in the image heating device of the roller heating type shown in FIG. 14, in order to obtain a desired thermal capacity by reducing a thickness of the heat generating layer 821 while using an electric current at the same frequency as an electric current to be applied to the excitation coil 825, it is required that the thickness be reduced so as to be smaller than a skin depth, i.e. a thickness defined by a flow of an induction current. With such a reduction in thickness, magnetic flux (leakage magnetic flux) that penetrates the heat generating layer 821 so as to leak therefrom is increased, so that in the supporting layer 824, an eddy current is generated to cause the supporting layer 824 to be heated. As a result, for example, bearings supporting the supporting layer 824 are heated, and thus deterioration and breakage are caused in the bearings, and the rate of power contributing to heat generation of the heat generating layer 821 is decreased, thereby undesirably causing an increase in warm-up time, which have been disadvantageous.

Similarly, in the image heating device of the belt heating type shown in FIG. 15, in order to obtain a desired thermal capacity by reducing a thickness of a heat generating layer of the metal sleeve 910 while using an electric current at the same frequency as an electric current to be applied to the coil assembly 960, it is required that the thickness be reduced so as to be smaller than a skin depth, i.e. a thickness defined by a flow of an induction current. With such a reduction in thickness, magnetic flux that penetrates the heat generating layer so as to leak therefrom reaches the inner pressing roller 920, so that in the inner pressing roller 920, an eddy current is generated to cause the inner pressing roller 920 to be heated. As a result, for example, bearings supporting the inner pressing roller 920 are heated, and thus deterioration and breakage are caused in the bearings, and the rate of power contributing to heat generation of the heat generating layer is decreased, thereby undesirably causing an increase in warm-up time, which have been disadvantageous.

In order to prevent these problems, the skin depth should be reduced so as to be smaller than a thickness of the heat generating layer. However, in order to reduce the skin depth, it is required that an electric current at a higher frequency be applied, thereby resulting in problems such as an increase in cost of an excitation circuit and an increase in leaking electromagnetic wave noise.

Moreover, since the heat generating layer is deformed repeatedly at the nip part by the pressing roller (the pressing roller 827 shown in FIG. 14, the outer pressing roller 930 shown in FIG. 15), in the case of the heat generating layer formed by nickel electroforming, a problem of lower mechanical durability of the heat generating layer arises. Further, in the case of the heat generating layer formed from stainless steel, while improved durability is provided, a problem of an increase in warm-up time arises.

DISCLOSURE OF THE INVENTION

In order to solve the above-mentioned problems with the conventional devices, it is an object of the present invention to provide a heating roller that achieves a reduction in warm-up time, prevents a shaft core from being heated so that no deterioration or breakage is caused in bearings, and requires no use of a high-frequency power source for heating. Further, it is another object of the present invention to provide an image heating device that achieves a reduction in leaking electromagnetic wave noise, allows rapid heating, and suppresses thermal deterioration of bearings. Moreover, it is still another object of the present invention to provide an image forming apparatus that achieves a reduction in warm-up time and an excellent quality of a fixed image.

In order to achieve the above-mentioned objects, the present invention has the following configurations.

A heating roller according to the present invention is a roller-shaped heating roller including a heat generating layer that generates heat by electromagnetic induction, a heat insulating layer, and a supporting layer, which are provided inwardly in this order. In the heating roller, the supporting layer contains a material having a specific resistance of $1\times10^{-5}$ Ωm or higher.

Next, a first image heating device according to the present invention includes the above-mentioned heating roller according to the present invention, an excitation unit that heats the heat generating layer by external excitation, and a pressing unit that makes contact under pressure with the heating roller to form a nip part. In the first image heating device, a recording material carrying an image is passed through the nip part so that the image is fixed thermally.

Furthermore, a second image heating device according to the present invention includes a heating belt having a heat generating layer that generates heat by electromagnetic induction, an excitation unit that heats the heat generating layer by external excitation, a supporting roller that makes contact internally with and rotatably supports the heating belt, and a pressing unit that makes contact externally with the heating belt to form a nip part. In the second image heating device, a recording material carrying an image is passed through the nip part so that the image is fixed thermally. The supporting roller contains a material having a specific resistance of $1\times10^{-5}$ Ωm or higher.

Moreover, an image forming apparatus according to the present invention includes an image forming unit in which an unfixed image is formed on a recording material and carried by the recording material and an image heating device that thermally fixes the unfixed image on the recording material. In the image forming apparatus, the image heating device is the above-mentioned first or second image heating device according to the present invention.

BEST MODE FOR CARRYING OUT THE INVENTION

[Embodiment I]

Figure 5:
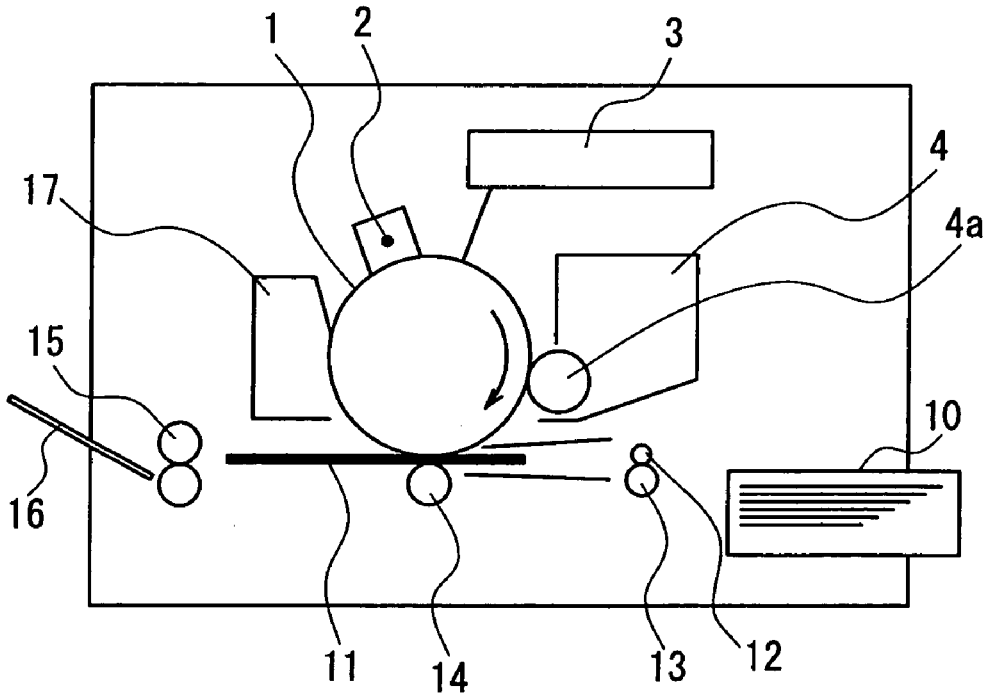
FIG. 5 is a cross sectional view schematically showing a configuration of an image forming apparatus according to Embodiment I of the present invention.

FIG. 5 is a cross sectional view of an example of an image forming apparatus according to the present invention, in which an image heating device is used as a fixing device. An image heating device mounted in an image forming apparatus according to Embodiment I is an electromagnetic induction heating device of the roller heating type. The following description is directed to a configuration and an operation of this device.

Reference numeral 1 denotes an electrophotographic photoreceptor (hereinafter, referred to as a "photosensitive drum"). The photosensitive drum 1, while being driven to rotate at a predetermined peripheral velocity in a direction indicated by an arrow, has its surface charged negatively in a uniform manner to a predetermined dark potential V0 by a charger 2.

Reference numeral 3 denotes a laser beam scanner that outputs a laser beam modulated in accordance with a time-series electric digital pixel signal of image information input from a host device such as an image reading apparatus, a computer or the like, which is not shown in the figure. A surface of the photosensitive drum 1 charged in a uniform manner as described above is scanned by and exposed to this laser beam, and thus an absolute potential value of an exposed portion is decreased to a light potential VL. Thus, a static latent image is formed on the surface of the photosensitive drum 1.

Next, the latent image is reversely developed by a developer 4 using negatively charged powdered toner and made manifest.

The developer 4 includes a developing roller 4*a* that is driven to rotate. A thin layer of toner carrying negative electric charge is formed on an outer peripheral face of the roller and opposed to the surface of the photosensitive drum 1. A developing bias voltage, which has an absolute value lower than the dark potential V0 of the photosensitive drum 1 and higher than the light potential VL, is applied to the developing roller 4*a*. Thus, the toner on the developing roller 4*a* is transferred only to a portion of the photosensitive drum 1 with the light potential VL, and a latent image is made manifest.

Meanwhile, a recording material (of, for example, paper) 11 is fed one at a time from a paper feeding part 10 and passed between a pair of resist rollers 12 and 13. Then, the recording material 11 is conveyed to a transferring part composed of the photosensitive drum 1 and a transferring roller 14 that is in contact with the photosensitive drum 1, and the timing thereof is appropriate and synchronized with the rotation of the photosensitive drum 1. By the action of the transferring roller 14 to which a transfer bias voltage is applied, toner images on the photosensitive drum 1 are transferred one after another to the recording material 11. The recording material 11 that has been passed through the transferring part is released from the photosensitive drum 1 and introduced to a fixing device 15 where fixing of the transferred toner image is performed. The recording material 11 on which the image is fixed by the fixing process is output to a paper ejecting tray 16.

The surface of the photosensitive drum 1 from which the recording material has been released is cleaned by removing residual materials such as toner remaining after the transferring process by a cleaning device 17 and used repeatedly for successive image formation.

The above-mentioned fixing device 15 includes a heating roller, an excitation unit that heats the heating roller by electromagnetic induction, and a pressing unit that makes contact under pressure with the heating roller to form a nip part.

A heating roller according to the present invention can be used suitably as the heating roller of the above-mentioned fixing device 15 and is a roller-shaped heating roller including a heat generating layer that generates heat by electromagnetic induction, a heat insulating layer, and a supporting layer, which are provided inwardly in this order. In the heating roller, the supporting layer contains a material having a specific resistance of $1\times10^{-5}$ Ωm or higher.

According to the heating roller described above, since the supporting layer is formed of a material having a specific resistance as high as $1\times10^{-5}$ Ωm or higher, even in the case where the heat generating layer has a thickness reduced to a thickness smaller than a skin depth, i.e. a thickness defined by a flow of an induction current, so that magnetic flux penetrates the heat generating layer and then even reaches the supporting layer, heat generation of the supporting layer due to an eddy current can be suppressed. Thus, breakage of, for example, bearings supporting the heating roller can be prevented.

Furthermore, the heat generating layer can be reduced in thickness so as to be decreased in thermal capacity, and heat generation of the supporting layer is suppressed, so that the heat generating layer alone can be heated efficiently. Thus, a warm-up time can be reduced.

Accordingly, it is not required that an electric current at a higher frequency be used to generate an excitation magnetic field, thereby preventing an increase in the occurrence of a switching loss in an excitation circuit. Further, an increase in cost of the excitation circuit and an increase in leaking electromagnetic wave noise also are prevented.

Furthermore, the heat generating layer can be reduced in thickness, and thus stress generated due to the deformation of the heat generating layer at the nip part is decreased in proportion to a decrease in the thickness of the heat generating layer. This allows the heat generating layer to have increased durability.

Furthermore, the heat generating layer is rotated integrally with the heat insulating layer and the supporting layer, and thus compared with the case of a device of the belt heating type, meandering of the heat generating layer can be prevented.

Moreover, the excitation unit can be placed outside the heating roller, and thus an excitation coil or the like that constitutes the excitation unit is prevented from being subjected to a high temperature, thereby allowing stable heating to be performed.

Herein, possible examples of a material that forms the supporting layer and has a specific resistance of $1\times10^{-5}$ Ωm or higher include ferrite, ceramics, PEEK (polyether ether ketones), PI (polyimide) and the like. Preferably, the material forming the supporting layer has a specific resistance of 1 Ωm or higher.

Preferably, the heat generating layer of the above-mentioned heating roller according to the present invention is formed of a magnetic material and has a thickness of 1 to 80 μm. Herein, a magnetic material refers to a ferromagnet, possible examples of which include iron, Permalloy, nickel, chromium, cobalt, ferritic stainless steel (SUS430), martensitic stainless steel (SUS416) and the like.

By using a magnetic material to form the heat generating layer, even the heat generating layer having a thickness as small as 1 to 80 μm can generate heat efficiently. Thus, the heat generating layer is reduced in thermal capacity, thereby allowing a warm-up time to be reduced. Further, it is no longer necessary to use an electric current at a higher frequency for the excitation circuit, and thus a cost increase can be prevented. Further, the heat generating layer can be reduced in thickness and thus has lower rigidity. Therefore, the heat generating layer is deformed easily along a pressing roller, and excellent separability of a recording material is provided. Moreover, a reduction in thickness of the heat generating layer allows the generation of stress to be reduced even in the case where the heat generating layer is deformed repeatedly along the pressing roller. This allows the heat generating layer to have increased durability. It is not preferable that the heat generating layer has a thickness smaller than 1 μm, because this causes the heat generation layer to have decreased mechanical strength.

Alternatively, the heat generating layer of the above-mentioned heating roller according to the present invention may be formed of a non-magnetic material and have a thickness of 1 to 20 μm. Herein, a non-magnetic material refers to a paramagnet and a diamagnet, possible examples of which include aluminum, gold, silver, copper, brass, phosphor bronze and the like.

Even the heat generating layer formed of a non-magnetic material, when reduced in thickness to a thickness as small as 1 to 20 μm, can generate heat even when an electric current at a low frequency is used for the excitation circuit. Thus, the heat generating layer is reduced in thickness so as to be decreased in thermal capacity, thereby allowing a warm-up time to be reduced further. Further, it is no longer necessary to use an electric current at a higher frequency for the excitation circuit, and thus a cost increase can be prevented. Further, the heat generating layer can be reduced in thickness and thus has lower rigidity. Therefore, the heat generating layer is deformed easily, and excellent separability of a recording material is provided. Further, the heat generating layer is increased in durability. It is not preferable that the heat generating layer has a thickness smaller than 1 μm, because this causes the heat generating layer to be decreased in mechanical strength.

Preferably, the heat insulating layer of the above-mentioned heating roller according to the present invention is formed of a formed elastic body having a thermal conductivity of not more than 0.9 W/m·K. Possible examples of such a material of the heat insulating layer include silicone rubber, fluorocarbon rubber, fluorocarbon resin and the like. The heat insulating layer is formed of a foamed elastic body having low thermal conductivity, and thus heat of the heat generating layer hardly is transmitted to the heat insulating layer and the supporting layer, thereby allowing a warm-up time to be reduced.

The supporting layer of the above-mentioned heating roller according to the present invention can be formed from ceramics. Possible examples of ceramics that can be used include alumina, zirconia, aluminum nitride, silicon nitride, silicon carbide and the like. Since ceramics have high rigidity and high heat resistance, by using such ceramics to form the supporting layer, the deformation of the supporting layer is suppressed, and the nip part can be formed so as to be uniform in a width direction of a recording material. Further, even over long hours of operation, the nip part can be maintained stably in such a state. Further, since ceramics are shaped in a molding process with a relatively high degree of freedom, the supporting layer easily can be formed into a desired shape. Further, since ceramics have a high specific resistance, heat generation is not caused, and thus no breakage is caused in bearings or the like, and a warm-up time can be reduced.

Furthermore, the supporting layer of the above-mentioned heating roller according to the present invention may be formed of a material containing at least an oxide magnetic body. Possible examples of an oxide magnetic body that can be used include nickel-zinc ferrite, barium ferrite and the like. Further, a composite magnetic body formed by solidifying a mixture of ferrite powder of these materials and rubber, plastic or the like also may be used. Oxide magnetic bodies are less costly materials having high rigidity and a relatively high degree of freedom of shape. Further, oxide magnetic bodies have high magnetic permeability, and thus magnetic coupling between an oxide magnetic body and the excitation unit is enhanced, thereby allowing a warm-up time to be reduced. Further, although passage of magnetic flux through an oxide magnetic body is ensured, the oxide magnetic body has a high specific resistance, and thus heat generation is not caused under an excitation magnetic field.

Furthermore, preferably, the supporting layer of the above-mentioned heating roller according to the present invention is composed of a rotary shaft and a shielding layer formed on a surface of the rotary shaft, and the shielding layer is formed of a material containing at least an oxide magnetic body. Possible examples of an oxide magnetic body that can be used include nickel-zinc ferrite, barium ferrite and the like. Further, a composite magnetic body formed by solidifying a mixture of ferrite powder of these materials and rubber, plastic or the like also may be used. Since the shielding layer is formed of a material containing an oxide magnetic body, the magnetic permeability of the shielding layer is increased. Therefore, magnetic flux that has penetrated the heat generating layer passes through the shielding layer and thus is prevented from passing through the rotary shaft. Thus, regardless of a material of the rotary shaft, heat generation in the rotary shaft can be prevented. Further, magnetic coupling between the shielding layer and the excitation unit is enhanced, and thus a larger output can be produced by induction heating, thereby allowing a warm-up time to be reduced.

Preferably, in the above-mentioned case, the rotary shaft is formed from a metal having a specific resistance of $3\times10^{-6}$ Ωm or lower. The presence of the shielding layer can prevent magnetic flux from passing through the rotary shaft, and thus the rotary shaft can be formed of a less costly metallic material having a low specific resistance value and high rigidity. As a result, the nip part that is less costly and is uniform in the width direction of a recording material can be obtained. Possible examples of a material of the rotary shaft having such a low specific resistance value include aluminum, brass, austenitic stainless steel (SUS304), ferritic stainless steel (SUS430), martensitic stainless steel (SUS416) and the like.

Furthermore, preferably, the above-mentioned rotary shaft is formed from a non-magnetic metal. Herein, a non-magnetic metal refers to a paramagnet and a diamagnet, possible examples of which include aluminum, brass, austenitic stainless steel (SUS304) and the like. As described above, since the shielding layer formed of a material containing an oxide magnetic body is provided on the surface of the rotary shaft, magnetic flux reaching the rotary shaft is reduced. Thus, even in the case where the rotary shaft is formed of a non-magnetic metallic material (more preferably, with a low specific resistance), namely a metallic material in general use, heat generation of the rotary shaft is limited to a minimal level, thereby preventing the breakage of bearings or the like. Further, by using a metallic material in general use to form the rotary shaft, even the rotary shaft with a small diameter can be increased in rigidity, and a cost reduction of the heating roller also can be achieved.

Furthermore, preferably, the supporting layer of the above-mentioned heating roller according to the present invention has a diameter that is the largest at a center portion in a longitudinal direction and decreases gradually in directions toward both ends. According to this configuration, the supporting layer has increased rigidity at the center portion, and thus the bending moment and distortion are decreased, thereby allowing the nip part that is uniform in the width direction of a recording material to be obtained. Moreover, in the longitudinal direction, the thickness of the heat insulating layer is decreased at the center portion and increased at both end portions, so that in the longitudinal direction, the hardness of an outer surface of the heating roller is increased at the center portion and decreased in both the end portions. This distribution of hardness compensates for a decrease in pressing force in the nip part that is caused at the center portion in the longitudinal direction due to distortion. Thus, a nip length and a pressing force that are more uniform in the width direction of a recording material can be obtained.

An image heating device according to the present invention includes the above-mentioned heating roller according to the present invention, an excitation unit that heats the heat generating layer by external excitation, and a pressing unit that makes contact under pressure with the heating roller to form a nip part. In the image heating device, a recording material carrying an image is passed through the nip part so that the image is fixed thermally.

According to this configuration, an image heating device can be provided that allows the heating roller to be heated rapidly without causing breakage of a bearing part of the heating roller and achieves a reduction in leaking electromagnetic wave noise.

Furthermore, an image forming apparatus according to the present invention includes an image forming unit in which an unfixed image is formed on a recording material and carried by the recording material and an image heating device that thermally fixes the unfixed image on the recording material. In the image forming apparatus, the image heating device is the above-mentioned image heating device according to the present invention.

According to this configuration, an image forming apparatus can be obtained that achieves a reduction in warm-up time and an excellent quality of a fixed image.

Hereinafter, an embodiment of the heating roller according to the present invention and the image heating device according to the present invention that is used as the above-mentioned fixing device 15 will be described in detail by way of specific examples (examples).

(Embodiment I-1)

Figure 1:
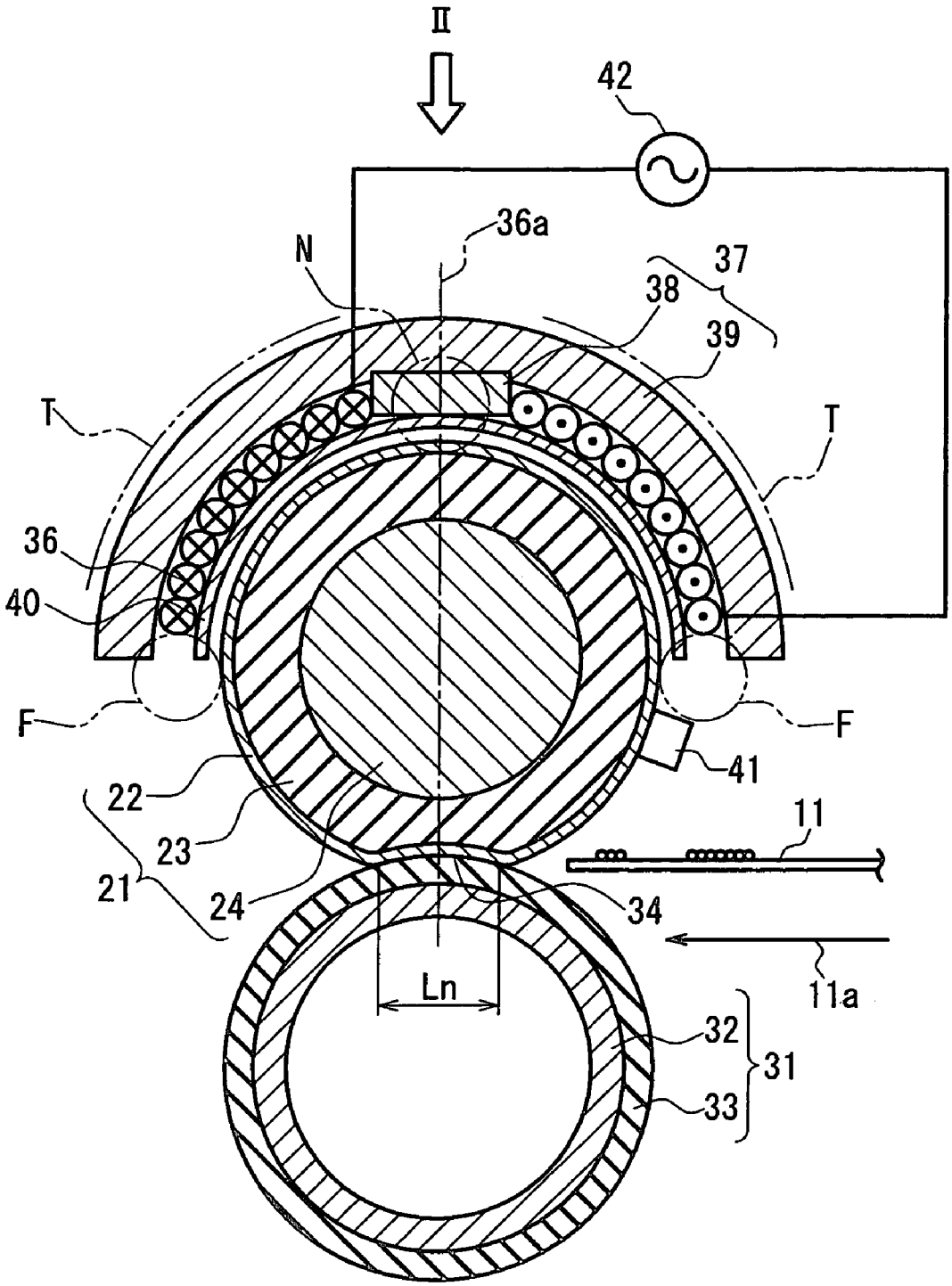
FIG. 1 is a cross sectional view of an image heating device according to Embodiment I-1 of the present invention.
Figure 2:
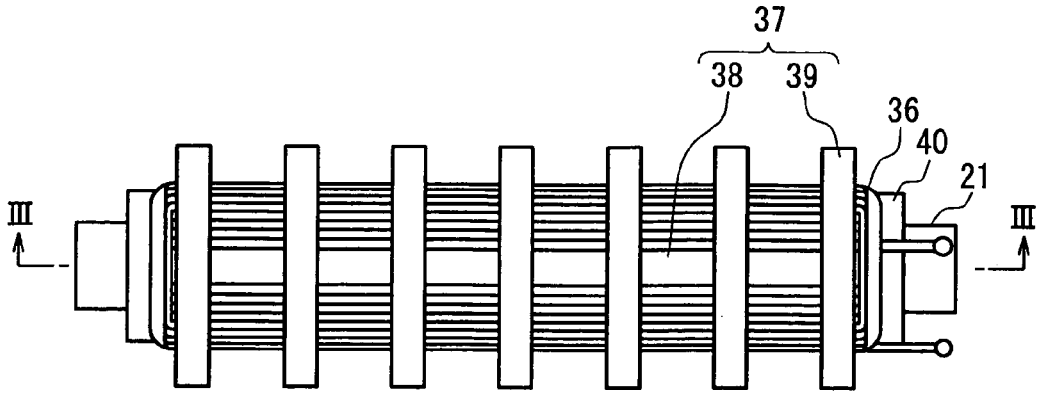
FIG. 2 is a structural view of an excitation unit as seen from a direction indicated by an arrow II of FIG. 1.
Figure 3:
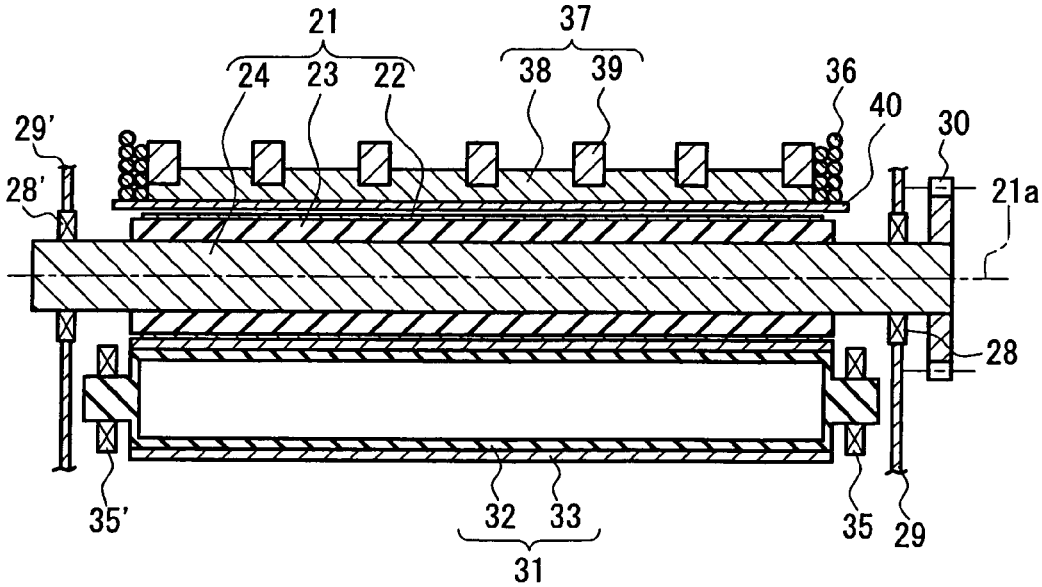
FIG. 3 is a cross sectional view taken on line III—III of FIG. 2 for showing the image heating device according to Embodiment I-1 of the present invention.
Figure 4:
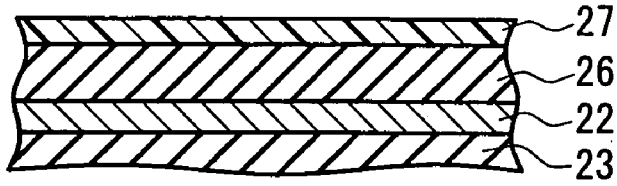
FIG. 4 is a partial cross sectional view of a surface layer portion of a heating roller including a heat generating layer, which is used in the image heating device according to Embodiment I-1 of the present invention.

FIG. 1 is a cross sectional view of an image heating device as a fixing device according to Embodiment I-1 of the present invention, which is used in the above-mentioned image forming apparatus shown in FIG. 5. FIG. 2 is a structural view of an excitation unit as seen from a direction indicated by an arrow II of FIG. 1. FIG. 3 is a perspective sectional view taken on line III—III (a plane including a rotation center axis 21*a* of a heating roller 21 and a winding center axis 36*a* of an excitation coil 36) of FIG. 2. FIG. 4 is a cross sectional view showing a layer configuration of a surface layer portion of the heating roller 21 including a heat generating layer 22.

Reference numeral 21 denotes the heating roller that is composed of the heat generating layer 22 formed of a thin conductive material, a heat insulating layer 23 formed of a material having low thermal conductivity, and a supporting layer 24 as a rotary shaft, which are provided in this order from a surface side so as to be in close contact with each other.

As shown in FIG. 4, a thin elastic layer 26 is formed on a surface of the heat generating layer 22, and a mold releasing layer 27 is formed further on a surface of the elastic layer 26.

The heat generating layer 22 is formed of a magnetic material that is particularly, a magnetic metal. Preferably, the heat generating layer 22 has a thickness of 1 to 80 μm. In an example, the heat generating layer 22 was formed of a thin endless belt-like material of 40 μm thickness that is formed from magnetic stainless steel SUS430.

The elastic layer 26 is provided so as to improve adhesion to a recording material. In the example, the elastic layer 26 was formed from silicone rubber and had a thickness of 200 μm and a hardness of 20 degrees (JIS-A). Although a configuration without the elastic layer 26 poses no problem, it is desirable to provide the elastic layer 26 in the case of obtaining a color image. The thickness of the elastic layer 26 is not limited to 200 μm, and it is desirable to set the thickness to be in a range of 50 μm to 500 μm. In the case where the elastic layer 26 has a thickness larger than the thicknesses in the above-mentioned range, the thermal capacity becomes too large, thereby requiring a longer warm-up time. In the case where the elastic layer 26 has a thickness smaller than the thicknesses in the above-mentioned range, the effect of providing adhesion to a recording material no longer is exerted. A material of the elastic layer 26 is not limited to silicone rubber, and other types of heat-resistant rubber and resin also may be used.

The mold releasing layer 27 is formed from a fluorocarbon resin such as PTFE (polytetrafluoroethylene), PFA (tetrafluoroethylene-perfluoroalkylvinyl ether copolymer), FEP (tetrafluoroethylene hexafluoropropylene copolymer) or the like. In the example, the mold releasing layer 27 was formed of a fluorocarbon resin layer having a thickness of 30 μm.

The supporting layer 24 is formed of a material having a high specific resistance. Specifically, the supporting layer 24 has a specific resistance of $1\times10^{-5}$ Ωm or higher. Moreover, preferably, the supporting layer 24 has a relative magnetic permeability of 1,000 or higher. In the example, the supporting layer 24 was formed from ferrite that was an oxide magnetic body having a specific resistance of 6.5 Ωm and a relative magnetic permeability of 2,200, and had a diameter of 20 mm.

The heat insulating layer 23 is formed of a foamed elastic body having low thermal conductivity. It is desirable that the heat insulating layer 23 have a hardness of 20 to 55 degrees (ASKER-C). In the example, the heat insulating layer 23 was formed of a 5-mm thick foam body of silicone rubber (thermal conductivity: 0.24 W/m·K). Further, the heat insulating layer 23 had a hardness of 45 degrees (ASKER-C) and elasticity.

In the example, the heating roller 21 had a diameter of 30 mm and an effective length allowing a margin with respect to a width (short side length) of a JIS size A4 paper sheet. The heat generating layer 22 is formed so as to have a width (length in a direction of the rotation center axis of the heating roller 21) that is slightly shorter than a width of the heat insulating layer 23 (see FIG. 3).

In the example, the heat generating layer 22 was bonded to the heat insulating layer 23. In this case, since the heat insulating layer 23 has elasticity, a configuration also is possible in which instead of being bonded, the heat generating layer 22 in the shape of an endless belt is fit on an outer periphery of the heat insulating layer 23 so as to be fixed thereto.

FIG. 3 is a perspective sectional view taken on line III—III of FIG. 2 and shows the configuration of the whole fixing device as seen from a lateral direction.

The heating roller 21 is held rotatably in such a manner that both ends of the supporting layer 24, which is the lowest layer of the heating roller 21, are supported by bearings 28 and 28' attached respectively to side plates 29 and 29'. Further, the heating roller 21 is driven to rotate by a driving unit of a main body of an apparatus, which is not shown in the figure, through a gear 30 fixed integrally to the supporting layer 24.

Reference numeral 36 denotes the excitation coil constituting the excitation unit. The excitation coil 36 is disposed so as to be opposed to a cylindrical face on an outer periphery of the heating roller 21. Further, the excitation coil 36 includes nine turns of a wire bundle composed of 60 wires of a copper wire with its surface insulated, which has an outer diameter of 0.15 mm.

The wire bundle of the excitation coil 36 is arranged, at end portions of the cylindrical face of the heating roller 21 in the direction of the rotation center axis 21*a*, in the form of an arc along outer peripheral faces of the end portions. The wire bundle is arranged, in a portion other than the end portions, along a generatrix of the cylindrical face. As shown in FIG. 1, which is a cross section orthogonal to the rotation center axis 21*a* of the heating roller 21, the wire bundle of the excitation coil 36 is arranged tightly without being overlapped (except in the end portions of the heating roller 21) on an assumed cylindrical face formed around the rotation center axis 21*a* of the heating roller 21 so as to cover the cylindrical face of the heating roller 21. Further, as shown in FIG. 3, which is a cross section including the rotation center axis 21*a* of the heating roller 21, in portions opposed to the end portions of the heating roller 21, the wire bundle of the excitation coil 36 is overlapped in two rows and thus forced into bulges. Thus, the whole excitation coil 36 is formed into a saddle-like shape. The winding center axis 36*a* of the excitation coil 36 is a straight line substantially orthogonal to the rotation center axis 21*a* of the heating roller 21, which passes through substantially a center point of the heating roller 21 in the direction of the rotation center axis 21*a*. The excitation coil 36 is formed so as to be substantially symmetrical with respect to the winding center axis 36*a*. The wire bundle is wound so that adjacent turns of the wire bundle are bonded to each other with an adhesive applied to their surface, thereby maintaining a shape shown in the figure. The excitation coil 36 is opposed to the heating roller 21 at a distance of about 2 mm from the outer peripheral face of the heating roller 21. In the cross section shown in FIG. 1, the excitation coil 36 is opposed to the outer peripheral face of the heating roller 21 in a large area defined by an angle of about 180 degrees with respect to the rotation center axis 21*a* of the heating roller.

Reference numeral 37 denotes a rear core, which together with the excitation coil 36, constitutes the excitation unit. The rear core 37 is composed of a bar-like central core 38 and a substantially U-shaped core 39. The central core 38 passes through the winding center axis 36*a* of the excitation coil 36 and is arranged parallel to the rotation center axis 21*a* of the heating roller 21. The U-shaped core 39 is arranged at a distance from the excitation coil 36 on a side opposite to that of the heating roller 21 with respect to the excitation coil 36. The central core 38 and the U-shaped core 39 are connected magnetically. As shown in FIG. 1, the U-shaped core 39 is of a U shape substantially symmetrical with respect to a plane including the rotation center axis 21*a* of the heating roller 21 and the winding center axis 36*a* of the excitation coil 36. As shown in FIGS. 2 and 3, a plurality of the U-shaped cores 39 described above are arranged at a distance from each other in the direction of the rotation center axis 21*a* of the heating roller 21. In the example, the width of the U-shaped core 39 in the direction of the rotation center axis 21*a* of the heating roller 21 was 10 mm, and seven such U-shaped cores 39 in total were arranged at a distance of 26 mm from each other. The U-shaped cores 39 capture magnetic flux from the excitation coil 36, which leaks to the exterior.

As shown in FIG. 1, both ends of each of the U-shaped cores 39 are extended to areas that are not opposed to the excitation coil 36, so that opposing portions F are formed, which are opposed to the heating roller 21 without the excitation coil 36 interposed between them. In contrast to the opposing portion F, portions of the U-shaped core 39 that are opposed to the heating roller 21 through the excitation coil 36 are referred to as magnetically permeable portions T. Further, the central core 38 is opposed to the heating roller 21 without the excitation coil 36 interposed between them and protrudes further than the U-shaped core 39 to a side of the heating roller 21 to form an opposing portion N. The opposing portion N of the protruding central core 38 is inserted into a hollow portion of a winding center of the excitation coil 36. In the example, the central core 38 had a cross-sectional area of 4 mm by 10 mm.

The rear core 37 can be formed from, for example, ferrite. As a material of the rear core 37, it is desirable to use a material having high magnetic permeability and a high specific resistance such as ferrite, Permalloy or the like. However, a material having somewhat low magnetic permeability can be used as long as the material is a magnetic material.

Reference numeral 40 denotes a heat insulating member that is formed from a resin having high heat resistance such as PEEK (polyether ether ketones), PPS (polyphenylene sulfide) or the like. In the example, the heat insulating member had a thickness of 1 mm.

Referring back to FIG. 1, a pressing roller 31 as a pressing unit is composed of a metal shaft 32 and an elastic layer 33 of silicone rubber that is laminated on a surface of the metal shaft 32. The elastic layer 33 has a hardness of 50 degrees (JIS-A) and is in contact under pressure with the heating roller 21 with a force of about 200 N in total to form a nip part 34.

The effective length of the pressing roller 31 is, while being substantially equal to the effective length of the heating roller 21, slightly longer than the width of the heat generating layer 22 (see FIG. 3). Therefore, pressure is applied to the heat generating layer 22 uniformly along an entire width between the heat insulating layer 23 of the heating roller 21 and the pressing roller 31. The pressing roller 31 is a follower roller that is supported rotatably by bearings 35 and 35' on both ends of the metal shaft 32.

Since the elastic layer 33 of the pressing roller 31 has a hardness higher than a hardness of a surface of the heating roller 21, as shown in FIG. 1, at the nip part 34, the heat generating layer 22 and the heat insulating layer 23 of the heating roller 21 are deformed into the shape of a concave along an outer peripheral face of the pressing roller 31. In the example, at the nip part 34, a nip length Ln (length of a deformed portion of the surface of the heating roller 21 at the nip part 34 along a traveling direction 11*a* of a recording material 11 (see FIG. 1)) was about 5.5 mm. Although an extremely large pressing force is applied to the heating roller 21 by the pressing roller 31, the nip length Ln at the nip part 34 is substantially the same in the direction of the rotation center axis of the heating roller 21. This can be achieved because: the solid supporting layer 24 bears the pressing force, and thus distortion of the heating roller 21 with respect to the rotation center axis 21*a* is suppressed to a minimal amount; and the thin heat generating layer 22 is supported by the supporting layer 24 through the heat insulating layer 23.

Furthermore, at the nip part 34, an outer surface of the heating roller 21 is deformed into the shape of a concave along an outer surface of the pressing roller 31. Thus, a traveling direction of the recording material 11 coming out of the nip part 34 forms an increased angle with the outer surface of the heating roller 21, thereby providing an excellent peeling property that allows the recording material 11 to be peeled off the heating roller 21.

As a material of the elastic layer 33 of the pressing roller 31, as well as the above-mentioned silicone rubber, heat-resistance resin and rubber such as fluorocarbon rubber, fluorocarbon resin and the like may be used. Further, in order to obtain improved abrasion resistance and mold releasability, a surface of the pressing roller 31 may be coated with a single material or a combination of materials selected from resin and rubber such as PFA, PTFE, FEP and the like. In order to prevent heat dissipation, it is desirable that the pressing roller 31 be formed of a material having low thermal conductivity.

In FIG. 1, reference numeral 41 denotes a temperature detecting sensor that slides while being in contact with the surface of the heating roller 21 so as to detect the temperature of the surface of the heating roller 21 at a portion right before entering the nip part 34, and feeds back a result of the detection to a controlling circuit that is not shown in the figure. In the example, during operation, this function was used to regulate the excitation power of an excitation circuit 42 so that the surface of the heating roller 21 at a portion right before entering the nip part 34 of the heating roller 21 was controlled so as to be at a temperature of 170 degrees centigrade. In this embodiment, in order to achieve the object of reducing a warm-up time, the heat generating layer 22 is set so as to have an extremely small thermal capacity.

The above-mentioned heating roller 21 and the excitation unit composed of the excitation coil 36 and the rear core 37 cause an eddy current to be generated in the heat generating layer 22 of the heating roller 21, so that the heat generating layer 22 generates heat. Hereinafter, this function will be described with reference to FIG. 6.

Figure 6:
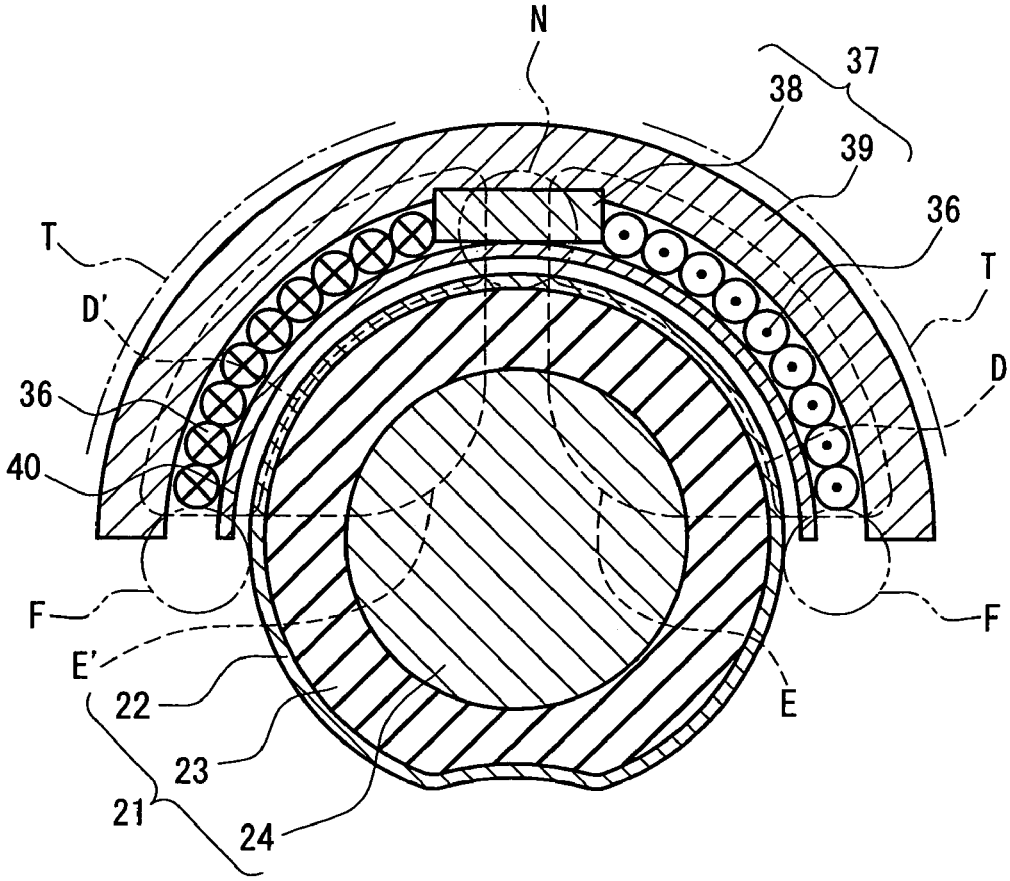
FIG. 6 is a cross sectional view for explaining a mechanism in which the excitation unit causes the heating roller to generate heat by electromagnetic induction in the image heating device according to Embodiment I-1 of the present invention.

In FIG. 6, magnetic flux generated at a particular moment by the excitation coil 36 enters the heat generating layer 22 of the heating roller 21 from the opposing portion N where the central core 38 is opposed to the heating roller 21 and passes through the heat generating layer 22. Then, the magnetic flux enters the U-shaped core 39 from the opposing portion F, passes though the U-shaped core 39, and returns to the central core 38. In the case where the heat generating layer 22 has a thickness not less than a skin depth, due to the magnetism of the heat generating layer 22, as shown by dotted lines D and D' in the figure, most of the magnetic flux passes through the heat generating layer 22. Most of eddy current generated by a phenomenon in which magnetic flux is generated and disappears repeatedly is generated only in the heat generating layer 22 by a skin effect, so that Joule heat is generated in the heat generating layer 22.

Herein, the skin depth is determined by the material of a member through which the magnetic flux passes and a frequency of an AC magnetic field. Calculation shows that, in the case where magnetic stainless steel SUS430 is used and an excitation current has a frequency of 25 kHz, a skin depth of about 0.25 mm is obtained. If the heat generating layer 22 has a thickness equal to or larger than this skin depth, most of the eddy current is generated in the heat generating layer 22. Accordingly, magnetic flux hardly reaches the supporting layer 24, so that even in the case where the supporting layer 24 is formed of, for example, a steel material, an eddy current hardly is generated in the supporting layer 24. Thus, the supporting layer 24 does not generate heat, and no substantial influence is exerted on heat generation of the heat generating layer 22.

However, in the case where the heat generating layer 22 is set so as to have a thickness not less than the skin depth, the heat generating layer 22 is increased in thermal capacity, and thus a warm-up time cannot be reduced. In this embodiment, in order to reduce the thermal capacity, the heat generating layer 22 was set to have a thickness of 40 μm. In order to obtain a skin depth of not more than 40 μm, i.e. the thickness of the heat generating layer 22, it is necessary to use an electric current at a frequency of about 900 kHz. However, this leads to problems such as a switching loss and an increase in cost of the excitation circuit 42, electromagnetic wave noise leaking to the exterior and the like and thus hardly can be put into practice.

Thus, an electric current that is used has a frequency, desirably, in a practical frequency range of 20 to 100 kHz, more desirably, in a range of 20 to 50 kHz. In this case, if the heat generating layer 22 is formed as a magnetic stainless steel SUS430 layer of 40 μm thickness, the thickness of the heat generating layer 22 is smaller than a skin depth. Therefore, conceivably, as well as magnetic fluxes (dotted lines D and D' in FIG. 6) that pass through the heat generating layer 22, magnetic fluxes (dotted lines E and E' in FIG. 6) that penetrate the heat generating layer 22 and then pass through the supporting layer 24 are generated by the excitation unit. A study was made on conditions of the supporting layer 24 that achieves the following. That is, when the conditions are satisfied, even in the above-mentioned case, heat generation of the supporting layer 24 caused by the magnetic fluxes reaching the supporting layer 24 is of a negligible level, and a reduction in warm-up time is realized. Specifically, under the above-mentioned conditions of the example, four different types of samples of the heating roller 21 were manufactured by respectively using, as a material of the supporting layer 24, iron (specific resistance: $9.4\times10^{-8}$ Ωm), aluminum (specific resistance: $2.5\times10^{-8}$ Ωm), PPS that is a heat-resistant resin (specific resistance: $1\times10^{-8}$ Ωm), and ferrite (specific resistance: 6.5 Ωm). With respect to the four types of the heating roller 21, a test was performed using an electric current at a frequency of 25 kHz to determine a warm-up time required for the surface of the heating roller 21 to attain a temperature of 170 degrees centigrade and a temperature rise at end portions (portions of the bearings 28 and 28') of the supporting layer 24. Table 1 shows the results of the determination.

TABLE 1

| Material of supporting layer | Output (W) for electromagnetic induction heating | Warm-up time (sec.) | Temperature of end portions of supporting layer (° C.) |
|---|---|---|---|
| Iron | 800 | 22 | 200 |
| Aluminum | 400 | 32 | 60 |
| PPS | 650 | 18 | 35 |
| Ferrite | 800 | 15 | 35 |

As is apparent from these results, in the case of using ferrite to form the supporting layer 24, a warm-up time was reduced, and heat generation also was not caused in the supporting layer 24, thereby allowing a stable fixing property to be obtained.

In contrast to this, in the case of using the heat-resistant resin PPS, while almost the same results were obtained in terms of the warm-up time and the heat generation of the supporting layer 24 as in the case of using ferrite, only insufficient rigidity was obtained, and thus a somewhat large amount of distortion was caused, thereby exhibiting non-uniformity of a nip pressure in a width direction of the nip part 34 (direction of the rotation center axis 21*a* of the heating roller 21). Moreover, in continuous use, heat of the heat generating layer 22 was transmitted to the supporting layer 24 though the heat insulating layer 23. Therefore, when the supporting layer 24 was heated to a temperature equal to or higher than a glass transition point thereof, the distortion of the supporting layer 24 was increased abruptly, so that the nip pressure in the width direction was made non-uniform.

In the case of using aluminum, magnetic coupling between the supporting layer 24 and the excitation unit was deteriorated. Therefore, when using the same electric current, an amount of power that could be applied was decreased, thereby requiring a longer warm-up time. Further, heat generation of the supporting layer 24 also was caused.

In the case of using iron, magnetic flux penetrates the heat generating layer 22 and then reaches the supporting layer 24. Because of this, a longer warm-up time was required, and the temperature of the supporting layer 24 was increased substantially, thereby presenting the possibility of causing breakage of bearings or the like.

In the above-mentioned test, magnetic stainless steel SUS430 was used to form the heat generating layer 22. However, the same effect can be attained in the case of using other magnetic metals such as iron, nickel and the like.

While being driven to rotate, the fixing device with the above-mentioned configuration using ferrite as a material of the supporting layer 24 was supplied with a power of 800 W at 25 kHz so that warming up was started from room temperature. Monitoring of the output of the temperature detecting sensor 41 showed that the temperature of the surface of the heating roller 21 reached 170 degrees centigrade after a lapse of about 15 seconds from a start of the power supply.

In the image forming apparatus including this fixing device, which is shown in FIG. 5, the recording material 11 to which a toner image had been transferred was allowed to enter in the direction indicated by an arrow 11*a* as shown in FIG. 1 so that toner on the recording material 11 was fixed.

In this embodiment, in order to achieve the object of reducing a warm-up time, the heat generating layer 22 is set to have a thickness not more than the skin depth, and this heat generating layer 22 is heated externally with efficiency by electromagnetic induction. The heat generating layer 22 is formed as a thin layer (having a thickness of 40 μm in the example). Therefore, the heat generating layer 22 has low rigidity and thus is easily deformed along the outer peripheral face of the pressing roller 31, thereby exhibiting an excellent peeling property of allowing the heat generating layer 22 to be peeled off the recording material 11. Moreover, with the reduction in thickness of the heat generating layer 22, even when the heat generating layer 22 is deformed repeatedly along the outer peripheral face of the pressing roller 31, stress generated in the heat generating layer 22 being deformed also is decreased in proportion to a decrease in thickness of the heat generating layer 22. This allows the heat generating layer 22 to have increased durability.

Furthermore, generally, the smaller the thermal capacity of a heating roller, the more sharply the temperature of a surface of the heating roller at a portion passing through a nip part is decreased due to heat absorption by a recording material and the like. On the other hand, in this embodiment, the elastic layer 26 on an outer side of the heat generating layer 22 and the heat insulating layer 23 on an inner side of the heat generating layer 22 store a certain amount of heat, and thus a temperature drop is suppressed, thereby allowing fixing to be performed at a constant temperature.

Furthermore, in this embodiment, the excitation unit composed of the excitation coil 36 and the rear core 37 is placed outside the heating roller 21, and thus a temperature rise in the excitation unit or the like, which is caused due to the influence of the temperature of a heat generating part, is suppressed, thereby allowing a stable amount of heat to be generated.

Furthermore, generally, with an increase in process speed, in order to secure a nip length Ln and a nip pressure that are necessary for fixing, it is required that a large pressure be caused between the heating roller 21 and the pressing roller 31. In this embodiment, such a pressure is received by the supporting layer 24 through the heat insulating layer 23 formed of an elastic body. Therefore, the distortion of the supporting layer 24 is suppressed to a relatively small amount, and thus the nip length Ln is made uniform in a width direction, and a wide nip region can be obtained.

As described above, in this embodiment, a heating roller and an image heating device can be provided that achieve a reduction in warm-up time and allow a sufficient nip length and nip pressure to be obtained, thereby attaining an excellent fixing property. Further, the heat generating layer 22 is rotated integrally with the heat insulating layer 23 and the supporting layer 24, and thus the heat generating layer 22 has reduced abrasion and dynamic resistance. Further, meandering of the heat generating layer 22 also is prevented.

(Embodiment I-2)

Figure 7:
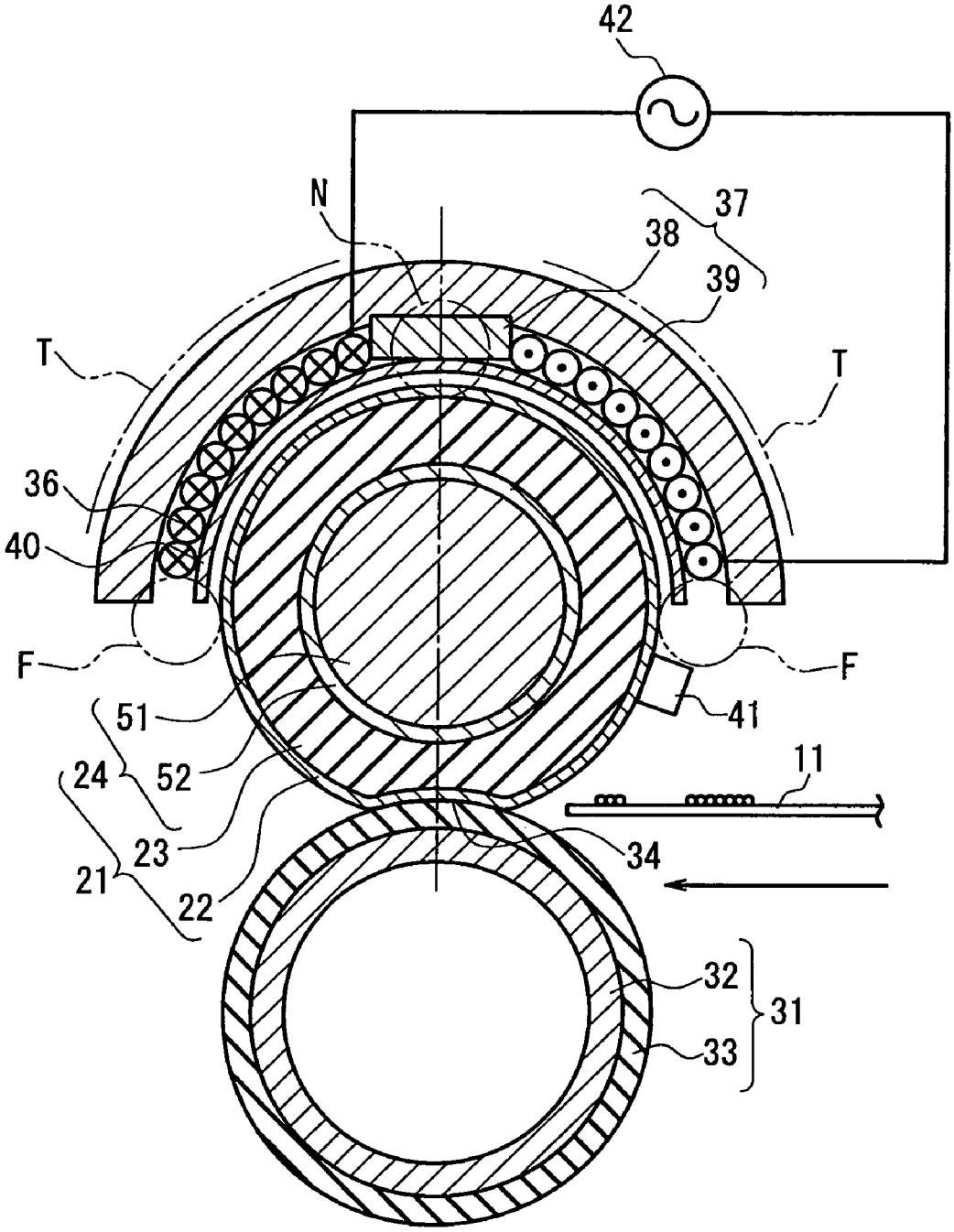
FIG. 7 is a cross sectional view of an image heating device according to Embodiments I-2 and I-3 of the present invention.
Figure 8:
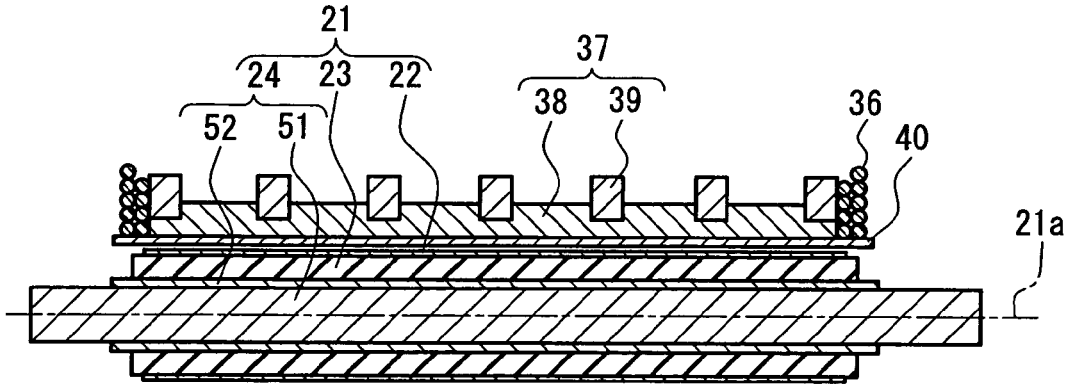
FIG. 8 is a cross sectional view of the image heating device according to Embodiments I-2 and I-3 of the present invention.
Figure 9:
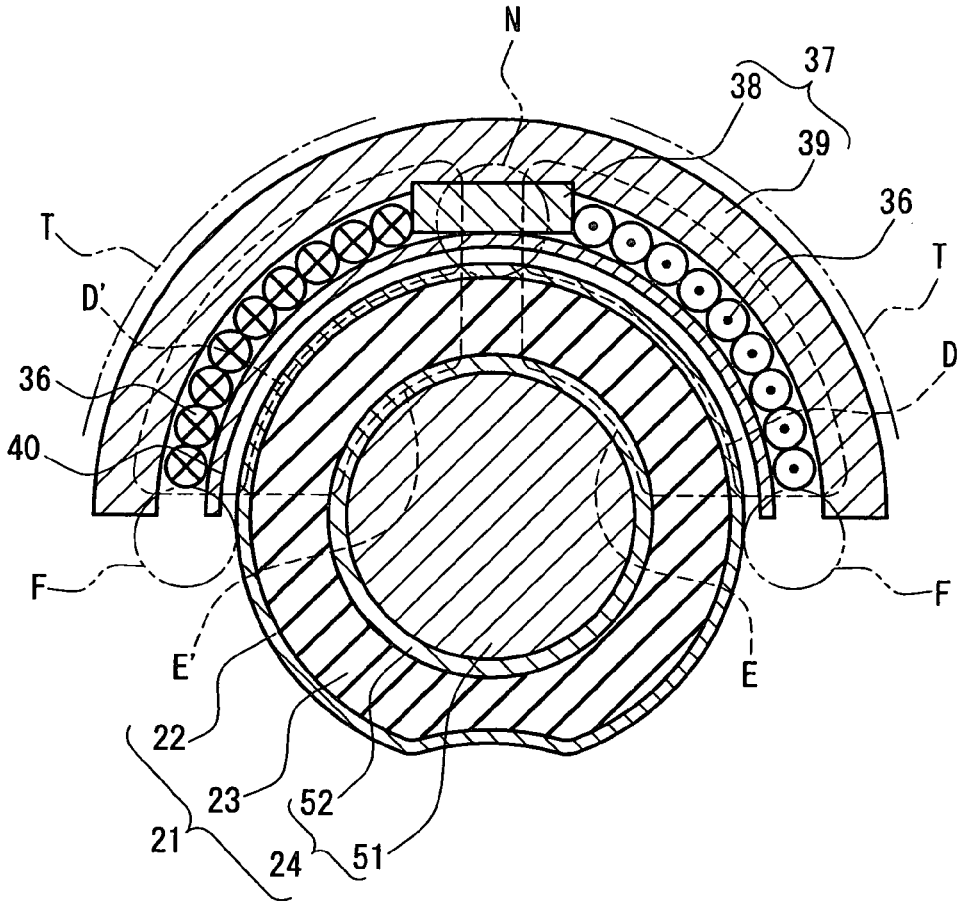
FIG. 9 is a cross sectional view for explaining a mechanism in which an excitation unit causes a heating roller to generate heat by electromagnetic induction in the image heating device according to Embodiments I-2 and I-3 of the present invention.

The description is directed next to an image heating device as a fixing device according to Embodiment I-2 with reference to FIGS. 7, 8 and 9. In Embodiment I-2, like reference characters indicate like members that have the same configurations and perform the same functions as those of the image heating device described with regard to Embodiment I-1, for which duplicate descriptions are omitted. In this embodiment, a pressing roller 31, an excitation coil 36, a rear core 37 and the like have the same configurations as those described with regard to Embodiment 1-1.

In an example according to this embodiment, as a heat generating layer 22, a 40-μm thick endless belt-like material of non-magnetic stainless steel SUS304that was formed by plastic working was used. Although SUS304essentially has no magnetism, the plastic working causes magnetism to be generated in SUS304. Further, compared with materials such as SUS430, nickel and the like, SUS304has superior durability against mechanical deformation as its essential property and thus is suitable for use in an induction heating roller subjected to repeated mechanical deformation.

As shown in FIGS. 7 and 8, a supporting layer 24 is composed of a rotary shaft 51 and a shielding layer 52 that is formed on a surface of the rotary shaft 51 and contains at least an oxide magnetic body. In the example, the rotary shaft 51 was formed of a non-magnetic material of stainless steel SUS304, and a 1-mm thick layer of ferrite that is an oxide magnetic body was formed on the surface of the rotary shaft 51 as the shielding layer 52. As shown in FIG. 8, the shielding layer 52 is formed in a direction of a rotation center axis 21*a* of a heating roller 21 in an area wider than an area in which the excitation coil 36 is wound. It is desirable that the shielding layer 52 have a specific resistance of 1 Ωm or higher, and in the example, the shielding layer 52 was set to have a specific resistance of 6.5 Ωm. Further, it is desirable that the shielding layer 52 have a relative magnetic permeability of 1,000 or higher, and in the example, the shielding layer 52 was set to have a relative magnetic permeability of 2,200. The same effect can be attained regardless of whether the thickness of the shielding layer 52 is smaller or larger than the above-mentioned value employed in the example. Further, the shielding layer 52 also can be formed of a thin layer of ferrite by a plating method. Further, the shielding layer 52 also may be formed by dispersing ferrite powder in a resin, and the same effect can be attained as long as the shielding layer 52 is formed of a material containing at least an oxide magnetic body.

Hereinafter, a function of heating the heat generating layer 22 of the heating roller 21 under an eddy current will be described with reference to FIG. 9. As in Embodiment I-1, since the heat generating layer 22 has a thickness smaller than a skin depth, magnetic flux generated by an excitation unit is separated into portions of the magnetic flux (dotted lines D and D') that pass through the heat generating layer 22 and portions of the magnetic flux (dotted lines E and E') that penetrate the heat generating layer 22 and then pass through the shielding layer 52. The shielding layer 52 has magnetism, and thus the portions of the magnetic flux are prevented from penetrating the shielding layer 52 and then reaching the rotary shaft 51. Further, the shielding layer 52 has a high specific resistance (6.5 Ωm in the example) and thus hardly generates heat even when magnetic flux passes through the shielding layer 52. Further, the shielding layer 52 is formed in the direction of the rotation center axis 21*a* of the heating roller 21 in the area wider than the area in which the excitation coil 36 is placed. This prevents magnetic flux from entering the rotary shaft 51 from both end portions of the rotary shaft 51, in which the shielding layer 52 is not formed. Thus, the rotary shaft 51 is prevented from being heated, so that breakage is not caused in bearings or the like. Further, the shielding layer 52 has magnetism, and thus magnetic coupling between the shielding layer 52 and the excitation unit is enhanced, thereby allowing larger power to be applied. Thus, heat generation of the heat generating layer 22 attains a sufficient level, and a warm-up time can be reduced.

Except for the above-mentioned point, the example according to this embodiment is the same as the example according to Embodiment I-1.

In order to verify the effect of this embodiment, the heating roller 21 using the supporting layer 24 of the above-mentioned example was manufactured. With respect to this heating roller 21, a warm-up time of the heat generating layer 22 and a temperature rise at end portions (portions of bearings 28 and 28') of the supporting layer 24 were determined using an electric current at a frequency of 25 kHz. As a second example, similarly, the same test was performed with respect to the case different only in that the rotary shaft 51 was formed from aluminum. Table 2 shows the results of the tests.

TABLE 2

| Materials of supporting layer Rotary shaft/ Shielding layer | Output (W) for electromagnetic induction heating | Warm-up time (sec.) | Temperature of end portions of supporting layer (° C.) |
|---|---|---|---|
| SUS304/Ferrite | 800 | 18 | 50 |
| Aluminum/Ferrite | 750 | 18 | 45 |

As is apparent from these results, in the case where the supporting layer 24 is composed of two layers, and the shielding layer 52 formed from ferrite having magnetism and a high specific resistance is formed as a layer closer to the excitation coil 36, compared with the case of the supporting layer 24 formed of a single layer of iron or aluminum, which is shown in Table 1 of Embodiment I-1, a warm-up time is reduced, and heat generation of the supporting layer 24 also is suppressed.

Furthermore, in Table 2, the two examples respectively using SUS304 and aluminum as a material of the rotary shaft 51 exhibit slight differences in the output for electromagnetic induction heating and the temperature of the rotary shaft 51. This indicates the possibility that in each of these examples, the shielding layer 52 has a thickness as relatively thin as 1 mm, and thus part of magnetic flux passing through the shielding layer 52 penetrates the shielding layer 52 and then passes through the rotary shaft 51. However, the differences in the output for electromagnetic induction heating and the temperature of the rotary shaft 51 between these examples are so small as to be negligible in practice and can be corrected by changing the thickness of the shielding layer 52.

While being driven to rotate, the fixing device with the above-mentioned configuration using SUS304as a material of the rotary shaft 51 was supplied with a power of 800 W at 25 kHz so that warming up was started from room temperature. Monitoring of the output of a temperature detecting sensor 41 showed that the temperature of a surface of the heating roller 21 reached 170 degrees centigrade after a lapse of about 18 seconds from a start of the power supply. Next, when passing paper sheets continuously, the temperature of both the end portions (portions of the bearings 28 and 28') of the rotary shaft 51 became about 50 degrees centigrade.

As described above, according to this embodiment, even in the case where the rotary shaft 51 is formed of a less costly metallic material having high mechanical rigidity, since the shielding layer 52 described above is provided on the surface of the rotary shaft 51, magnetic flux is caused to pass through the shielding layer 52, so that the rotary shaft 51 hardly is heated under eddy current. Thus, breakage is not caused in bearings or the like. Further, the heat generating layer 22 can be heated intensively, thereby allowing a warm-up time to be reduced.

(Embodiment I-3)

The description is directed next to an image heating device as a fixing device according to Embodiment I-3 with reference to FIG. 7. Tn Embodiment I-3, like reference characters indicate like members that have the same configurations and perform the same functions as those of the image heating device described with regard to Embodiment I-1, for which duplicate descriptions are omitted. In this embodiment, a pressing roller 31, an excitation coil 36, a rear core 37 and the like have the same configurations as those described with regard to Embodiment I-2.

In this embodiment, a heat generating layer 22 is formed of a non-magnetic material. Preferably, the heat generating layer 22 has a thickness of 1 to 20 μm. In an example, as the heat generating layer 22, a 15-μm thick copper layer was formed on a surface of a heat insulating layer 23 by plating or the like. A mold releasing layer 27 was formed further on a surface of the heat generating layer 22.

Except for this, this embodiment has the same configuration as that described with regard to Embodiment 1-2.

Hereinafter, a function of heating the heat generating layer 22 of a heating roller 21 under eddy current will be described with reference to FIG. 9. As in Embodiment I-2, since the heat generating layer 22 has a thickness smaller than a skin depth, magnetic flux generated by an excitation unit is separated into portions of the magnetic flux (dotted lines D and D') that pass through the heat generating layer 22 and portions of the magnetic flux (dotted lines E and E')

that penetrate the heat generating layer 22 and then pass through a shielding layer 52. Since the thickness of the heat generating layer 22 is as thin as 1 to 20 μm (15 μm in the example), despite its low specific resistance, the heat generating layer 22 has an increased skin resistance expressed by the following equation and thus generates heat.

A skin resistance Rs is expressed by the following equation where a specific resistance is indicated as ρ and a skin depth, i.e. a thickness as δ.

$$Rs=\rho/\delta$$

With an electric current at a frequency of 25 kHz, in the case of using iron that easily can be heated by induction heating, a skin depth of about 0.1 mm is obtained, and the skin resistance Rs thus obtained is $9.4\times10^{-4}$ Ω. On the other hand, copper has a specific resistance of $1.7\times10^{-8}$ Ωm, and if the thickness is 15 μm, the skin resistance Rs of $11.3\times10^{-4}$ Ω is obtained, which is substantially the same as that of iron, thereby enabling induction heating. In this case, the thermal capacity of the heat generating layer 22 is about one third of a thermal capacity of the heat generating layer 22 described with regard to the above-mentioned example of Embodiment I-2.

Thus, according to this embodiment, an electric current at a frequency of 25 kHz that is in common and frequent use can be set to be an electric current to be used, thereby preventing an increase in the occurrence of a switching loss of an excitation circuit 42 and a cost increase. Further, an increase in leaking electromagnetic wave noise also is prevented. Moreover, the heat generating layer 22 can be decreased in thermal capacity, thereby allowing a warm-up time to be reduced further.

(Embodiment I-4)

Figure 10:
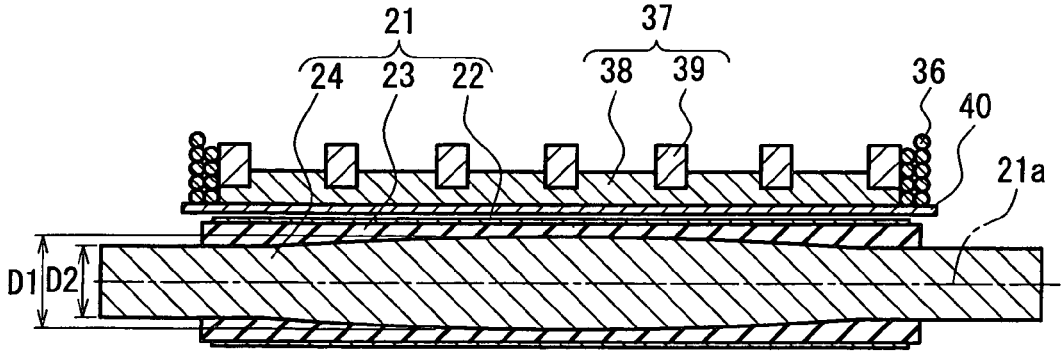
FIG. 10 is a cross sectional view of an image heating device according to Embodiment I-4 of the present invention.

The description is directed next to an image heating device as a fixing device according to Embodiment I-4 with reference to FIG. 10. In Embodiment I-4, like reference characters indicate like members that have the same configurations and perform the same functions as those of the image heating device described with regard to Embodiment I-1, for which duplicate descriptions are omitted. In this embodiment, a pressing roller 31, an excitation coil 36, a rear core 37 and the like have the same configurations as those described with regard to Embodiment I-1.

In this embodiment, as shown in FIG. 10, a supporting layer 24 is formed from ceramics that have a high specific resistance, high mechanical rigidity and high heat resistance. In an example, alumina (specific resistance: $2\times10^{17}$ Ωm) was used. Moreover, in a direction of a rotation center axis 21*a*, the supporting layer 24 has a diameter decreasing gradually in directions toward both end portions with its center portion having a maximum diameter D1. The diameter of the supporting layer 24 near both end portions of a heat insulating layer 23 is indicated as D2 (D2<D1). On the other hand, the outer diameter of the heat insulating layer 23 is uniform in the direction of the rotation center axis 21*a*. Accordingly, in the direction of the rotation center axis 21*a*, the heat insulating layer 23 has a thickness varying with a change in the diameter of the supporting layer 24.

Generally, in a configuration in which two opposed rollers are in contact under pressure with each other, each of the rollers has a bending moment and distortion that are maximum near a center in a direction of a rotation center axis. Accordingly, the nip length Ln shown in FIG. 1 tends to be decreased at a center portion and increased in both end portions, thereby causing non-uniformity of a nip in the direction of the rotation center axis 21*a* (width direction of a recording material). As a result, problems such as a fixing failure, gloss irregularity, paper wrinkles and the like are likely to be caused.

In this embodiment, in the direction of the rotation center axis 21*a*, the supporting layer 24 has a diameter decreasing gradually in directions toward both ends with its center portion having the maximum diameter. Thus, the rigidity at the center portion is increased, and thus the bending moment and distortion are decreased, thereby reducing the non-uniformity of the nip. Moreover, in the direction of the rotation center axis 21*a*, the thickness of the heat insulating layer 23 is not uniform but is smaller at the center portion and larger in both the end portions. As a result, the hardness of a heating roller 21 at its outer surface is increased at the center portion and decreased in both the end portions. This distribution of hardness compensates for a decrease in pressing force in a nip part that is caused at the center portion in the direction of the rotation center axis 21*a* due to distortion. Therefore, a nip length and a pressing force that are more uniform can be obtained. Thus, a fixing failure, gloss irregularity, paper wrinkles and the like can be eliminated.

The supporting layer 24 that has a varying diameter as in this embodiment can be manufactured with relative ease by powder molding using ceramic such as alumina or the like.

Except for the above-mentioned point, a fixing device is configured in the same manner as in the example of Embodiment I-1. While being driven to rotate, this fixing device was supplied with a power of 800 W at 25 kHz so that warming up was started from room temperature. Monitoring of the output of a temperature detecting sensor 41 showed that as in the case of the supporting layer 24 formed from PPS, which was described with regard to Embodiment I-1 and shown in Table 1, the temperature of a surface of the heating roller 21 reached 170 degrees centigrade after a lapse of about 18 seconds from a start of the power supply. When passing paper sheets continuously, the distortion of the supporting layer 24 was not increased abruptly as in the case of the supporting layer 24 formed from PPS, thereby enabling stable fixing, and almost no temperature rise was caused at both the end portions of the supporting layer 24.

In each of Embodiments I-1 to I-4 described above, a configuration was shown as an example, in which the excitation unit was composed of the saddle-shaped excitation coil 36 and the rear core 37. However, the excitation unit according to the present invention is not limited thereto as long as an alternating magnetic field can be generated. Further, a configuration was shown as an example, in which the pressing unit was formed of the rotatable pressing roller 31. However, the pressing unit according to the present invention is not limited thereto. For example, a pressing guide that is locked in a position while being in contact under pressure with the heating roller 21 also may be used.

[Embodiment II]

Figure 11:
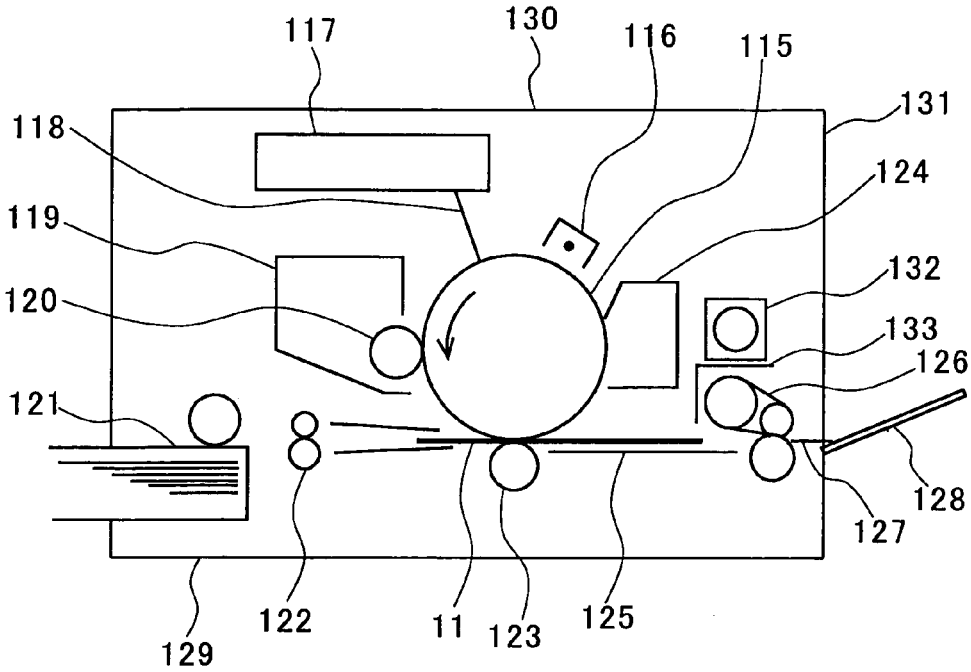
FIG. 11 is a cross sectional view schematically showing a configuration of an image forming apparatus according to Embodiment II of the present invention.

FIG. 11 is a cross sectional view of an example of an image forming apparatus according to the present invention, in which an image heating device is used as a fixing device. An image heating device mounted in an image forming apparatus according to Embodiment II is an electromagnetic induction heating device of the belt heating type. The following description is directed to a configuration and an operation of this apparatus.

In FIG. 11, reference numeral 115 denotes an electrophotographic photoreceptor (hereinafter, referred to as a "photosensitive drum"). The photosensitive drum 115, while being driven to rotate at a predetermined peripheral velocity in a direction indicated by an arrow, has its surface charged uniformly to a negative dark potential V0 by a charger 116. Further, reference numeral 117 denotes a laser beam scanner that outputs a laser beam 118 corresponding to a signal of image information. The charged surface of the photosensitive drum 115 is scanned by and exposed to the laser beam 118. Thus, in an exposed portion of the photosensitive drum 115, an absolute potential value is decreased to a light potential VL, and a static latent image is formed. The latent image is developed with negatively charged toner of a developer 119 and made manifest.

The developer 119 includes a developing roller 120 that is driven to rotate. The developing roller 120 with a thin toner layer formed on an outer peripheral face is opposed to the photosensitive drum 115. A developing bias voltage, whose absolute value is lower than the dark potential V0 of the photosensitive drum 115 and higher than the light potential VL, is applied to the developing roller 120.

Meanwhile, a recording material 11 is fed one at a time from a paper feeding part 121 and passed between a pair of resist rollers 122. Then, the recording material 11 is conveyed to a nip part composed of the photosensitive drum 115 and a transferring roller 123, and the timing thereof is appropriate and synchronized with the rotation of the photosensitive drum 115. Toner images on the photosensitive drum 115 are transferred one after another to the recording material 11 by the transferring roller 123 to which a transfer bias voltage is applied. After the recording material 11 is released from the photosensitive drum 115, an outer peripheral face of the photosensitive drum 115 is cleaned by removing residual materials such as toner remaining after the transferring process by a cleaning device 124 and used repeatedly for successive image formation.

Reference numeral 125 denotes a fixing guide that guides the recording material 11 on which the image has been transferred to a fixing device 126. The recording material 11 is released from the photosensitive drum 115 and conveyed to the fixing device 126 where fixing of the transferred toner image is performed. Further, reference numeral 127 denotes a paper ejecting guide that guides the recording material 11, which has passed through the fixing device 126, to the exterior of the apparatus. The fixing guide 125 and the paper ejecting guide 127 that guide the recording material 11 are formed from a resin such as ABS or a non-magnetic metallic material such as aluminum. The recording material 11 on which the image has been fixed by the fixing process is ejected to a paper ejecting tray 128.

Reference numerals 129, 130, and 131 denote a bottom plate of a main body of the apparatus, a top plate of the main body, and a body chassis, which constitute a unit determining the strength of the main body of the apparatus. These strength members are formed of a material that uses a magnetic material of steel as a base material and is plated with zinc.

Reference numeral 132 denotes a cooling fan that generates airflow in the apparatus. Further, reference numeral 133 denotes a coil cover formed of a non-magnetic material such as aluminum, which is configured so as to cover an excitation coil 36 and a rear core 37 that constitute the fixing device 126.

The above-mentioned fixing device 126 includes a heating belt having a heat generating layer that generates heat by electromagnetic induction, an excitation unit that heats the heat generating layer by external excitation, a supporting roller that makes contact internally with and rotatably supports the heating belt, and a pressing unit that makes contact externally with the heating belt to form a nip part. In the fixing device 126, the recording material 11 carrying an image is passed through the nip part so that the image is fixed thermally.

Herein, the supporting roller contains a material having a specific resistance of $1\times10^{-5}$ Ωm or higher.

According to this configuration, even in the case where the heat generating layer of the heating belt has a thickness smaller than a skin depth, i.e. a thickness defined by a flow of an induction current, and thus magnetic flux penetrates the heat generating layer and then reaches the supporting roller, heat generation of the supporting roller under an eddy current can be suppressed. This can prevent breakage of, for example, bearings supporting the supporting roller.

Further, the heat generating layer can be reduced in thickness so as to be decreased in thermal capacity, and heat generation of the supporting roller is suppressed, so that the heat generating layer alone can be heated efficiently. Thus, a warm-up time can be reduced.

Thus, it is not required that an electric current at a higher frequency be used to generate an excitation magnetic field, thereby preventing an increase in the occurrence of a switching loss in an excitation circuit. Further, an increase in cost of the excitation circuit and an increase in leaking electromagnetic wave noise also are prevented.

Furthermore, the heat generating layer can be reduced in thickness, and thus stress generated due to the deformation of the heat generating layer at the nip part is decreased in proportion to a decrease in the thickness of the heat generating layer. This allows the heat generating layer to have increased durability.

Moreover, the excitation unit can be placed outside the heating belt, and thus an excitation coil or the like that constitutes the excitation unit is prevented from being subjected to a high temperature, thereby allowing stable heating to be performed.

Herein, possible examples of a material of the supporting roller that has a specific resistance of $1\times10^{-5}$ Ωm or higher include ferrite, ceramics, PEEK (polyether ether ketones), PI (polyimide) and the like. Preferably, the material forming the supporting roller has a specific resistance of 1 Ωm or higher.

Furthermore, an image forming apparatus according to the present invention includes an image forming unit in which an unfixed image is formed on a recording material and carried by the recording material and an image heating device that thermally fixes the unfixed image on the recording material. In the image forming apparatus, the image heating device is the above-mentioned image heating device according to the present invention.

According to this configuration, an image forming apparatus can be obtained that achieves a reduction in warm-up time and an excellent quality of a fixed image.

Hereinafter, an embodiment of an image heating device according to the present invention that is used as the above-mentioned fixing device 126 will be described in detail by way of specific examples (examples).

(Embodiment II-1)

Figure 12:
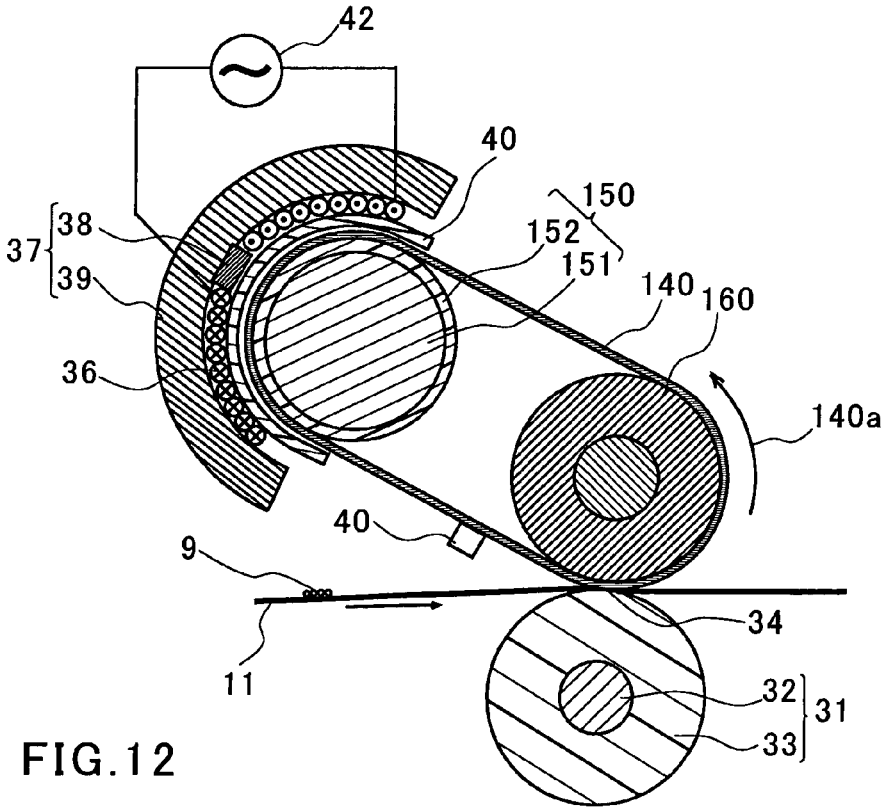
FIG. 12 is a cross sectional view of an image heating device according to Embodiment II-1 of the present invention.

FIG. 12 is a cross sectional view of an image heating device as a fixing device according to Embodiment II-1 of the present invention, which is used in the above-mentioned image forming apparatus shown in FIG. 11. In this embodiment, like reference characters indicate like members that have the same configurations and perform the same functions as those of the image heating device described with regard to Embodiment I-1, for which duplicate descriptions are omitted. In this embodiment, an excitation unit including an excitation coil 36 and a rear core 37, a heat insulating member 40 and a pressing roller 31 have the same configurations as those described with regard to Embodiment I-1.

In FIG. 12, a thin heating belt 140 is an endless belt including an induction heat generating layer (hereinafter, referred to simply as "heat generating layer"). An elastic layer and a mold releasing layer are formed in this order on a surface of the heat generating layer. In an example, the heat generating layer is a 40-μm thick endless belt formed from Ni by electroforming.

The elastic layer is provided so as to improve adhesion to a recording material 11. In the example, the elastic layer was formed of a silicone rubber layer having a thickness of 200 μm and a hardness of 20 degrees (JIS-A). Although a configuration without the elastic layer poses no problem, it is desirable to provide the elastic layer in the case of obtaining a color image. The thickness of the elastic layer is not limited to 200 μm, and it is desirable to set the thickness to be in a range of 50 μm to 500 μm. In the case where the elastic layer has a thickness larger than the thicknesses in the above-mentioned range, the thermal capacity becomes too large, thereby requiring a longer warm-up time. In the case where the elastic layer has a thickness smaller than the thicknesses in the above-mentioned range, the effect of providing adhesion to the recording material 11 no longer is exerted. A material of the elastic layer is not limited to silicone rubber, and other types of heat-resistant rubber and resin also may be used.

The mold releasing layer is formed from a fluorocarbon resin such as PTFE (polytetrafluoroethylene), PFA (tetrafluoroethylene-perfluoroalkylvinyl ether copolymer), FEP (tetrafluoroethylene hexafluoropropylene copolymer) or the like. In the example, the mold releasing layer was formed of a fluorocarbon resin layer having a thickness of 30 μm.

Reference numerals 150 and 160 denote a supporting roller of 20 mm in diameter and a fixing roller of 20 mm in diameter having low thermal conductivity, respectively. A surface of the fixing roller 160 is coated with silicone rubber that is an elastic foam body having a low hardness (ASKER-C45 degrees). The heating belt 140 is suspended with a predetermined tensile force between the supporting roller 150 and the fixing roller 160. The heating belt 140 is allowed to rotate in a direction indicated by an arrow 140*a*. Ribs (not shown) for preventing the heating belt 140 from meandering are provided on both ends of the supporting roller 150.

A pressing roller 31 as a pressing member is in contact under pressure with the fixing roller 160 through the heating belt 140, so that a nip part 34 is formed between the heating belt 140 and the pressing roller 31.

The supporting roller 150 is composed of a heat insulating layer 152 and a supporting layer 151, which are provided inwardly in this order. The supporting layer 151 is formed of a material having a high specific resistance. Specifically, the supporting layer 151 has a specific resistance of $1\times10^{-5}$ Ωm or higher. Moreover, it is preferable that the supporting layer 151 has a relative magnetic permeability of 1,000 or higher. In the example, the supporting layer 151 was formed from ferrite that is an oxide magnetic body having a specific resistance of 6.5 Ωm and a relative magnetic permeability of 2,200 and had a diameter of 20 mm. Further, it is desirable that the heat insulating layer 152 be formed of a foamed elastic body having low thermal conductivity and have a hardness of 20 to 55 degrees (ASKER-C). In the example, the heat insulating layer was formed of a 5-mm thick foam body of silicone rubber and had a hardness of 45 degrees (ASKER-C) and elasticity.

According to this embodiment, alternating magnetic flux from the excitation unit causes an eddy current to be generated in the heat generating layer of the heating belt 140 so as to cause the heat generating layer to generate heat by induction heating. The heating belt 140, which has been caused to generate heat, heats the recording material 11 and a toner image 9 formed on the recording material 11 at the nip part 34, so that the toner image 9 is fixed on the recording material 11.

Even in the case where leaking magnetic flux that has penetrated the heat generating layer of the heating belt 140 reaches the supporting roller 150, since the supporting layer 151 has a specific resistance of $1\times10^{-5}$ Ωm or higher, the supporting layer 151 is prevented from being heated.

In the example, while being driven to rotate, an image heating device having the above-mentioned configuration was supplied with a power of 800 W at 25 kHz so that warming up was started from room temperature. Monitoring of the output of a temperature detecting sensor 41 showed that the temperature of a surface of the heating belt 140 reached 170 degrees centigrade after a lapse of about 15 seconds from a start of the power supply. Further, no heat was generated in the supporting layer 151 of the supporting roller 150, and thus breakage was not caused in bearings of the supporting roller 150 or the like.

As the heat generating layer of the heating belt 140 according to this embodiment, the configurations of the heat generating layer 22 of the heating roller 21 described above with regard to Embodiments I-1 to I-4 can be used. According to the configurations, the same effects as those of Embodiments I-1 to I-4 can be attained.

Furthermore, as the supporting layer 151 and the heat insulating layer 152 of the supporting roller 150 according to this embodiment, the configurations of the supporting layer 24 and the heat generating layer 23 of the heating roller 21 described above with regard to Embodiments I-1 to I-4 can be used. According to the configurations, the same effects as those of Embodiments I-1 to I-4 can be attained.

Furthermore, the fixing roller 160 according to this embodiment also may have a configuration in which as described with regard to Embodiment I-4, the fixing roller 160 includes a supporting layer and an elastic layer formed on an outer surface of the supporting layer, and the supporting layer has a diameter that is the largest at a center portion in a longitudinal direction and decreases gradually in directions toward both ends. This configuration can attain the same effect as that of Embodiment I-4.

Moreover, this embodiment described a configuration in which the heat generating layer was provided in the heating belt 140, and only the heating belt 140 was caused to generate heat by induction heating. However, the same effect can be attained by a configuration in which both of the heating belt 140 and the supporting roller 150 are caused to generate heat by induction heating. That is, an induction heat generating layer is provided as a surface layer of the supporting roller 150 or provided in the vicinity of the surface layer, and the supporting layer 151 is formed of a material having a specific resistance of $1\times10^{-5}$ Ωm or higher. For example, if the induction heat generating layer of the supporting roller 150 is formed of a thin pipe formed from an iron alloy such as carbon steel or the like, both of the heating belt 140 and the supporting roller 150 are caused to generate heat by induction heating. In this case, while a warm-up time is increased slightly due to the thermal capacity of the supporting roller 150, the following can be achieved. That is, in the case where the recording materials 11 having a width smaller than a width of the heating belt 140 are passed continuously, heat is removed from only a portion of the heating belt 140 by the recording materials 11, thereby causing temperature variations in a width direction of the heating belt 140. Such temperature variations are reduced by heat transmission in the width direction through the supporting roller 150. Similarly in the case, since the supporting layer 151 of the supporting roller 150 is formed of a material having a specific resistance of $1 \times 10^{-5}$ Ωm or higher, heat generation of the supporting layer 151 is prevented.

(Embodiment II-2)

An image heating device according to Embodiment II-2 of the present invention that is used as the fixing device 126 of the image forming apparatus shown in FIG. 11 will be described in detail by way of an example.

Figure 13:
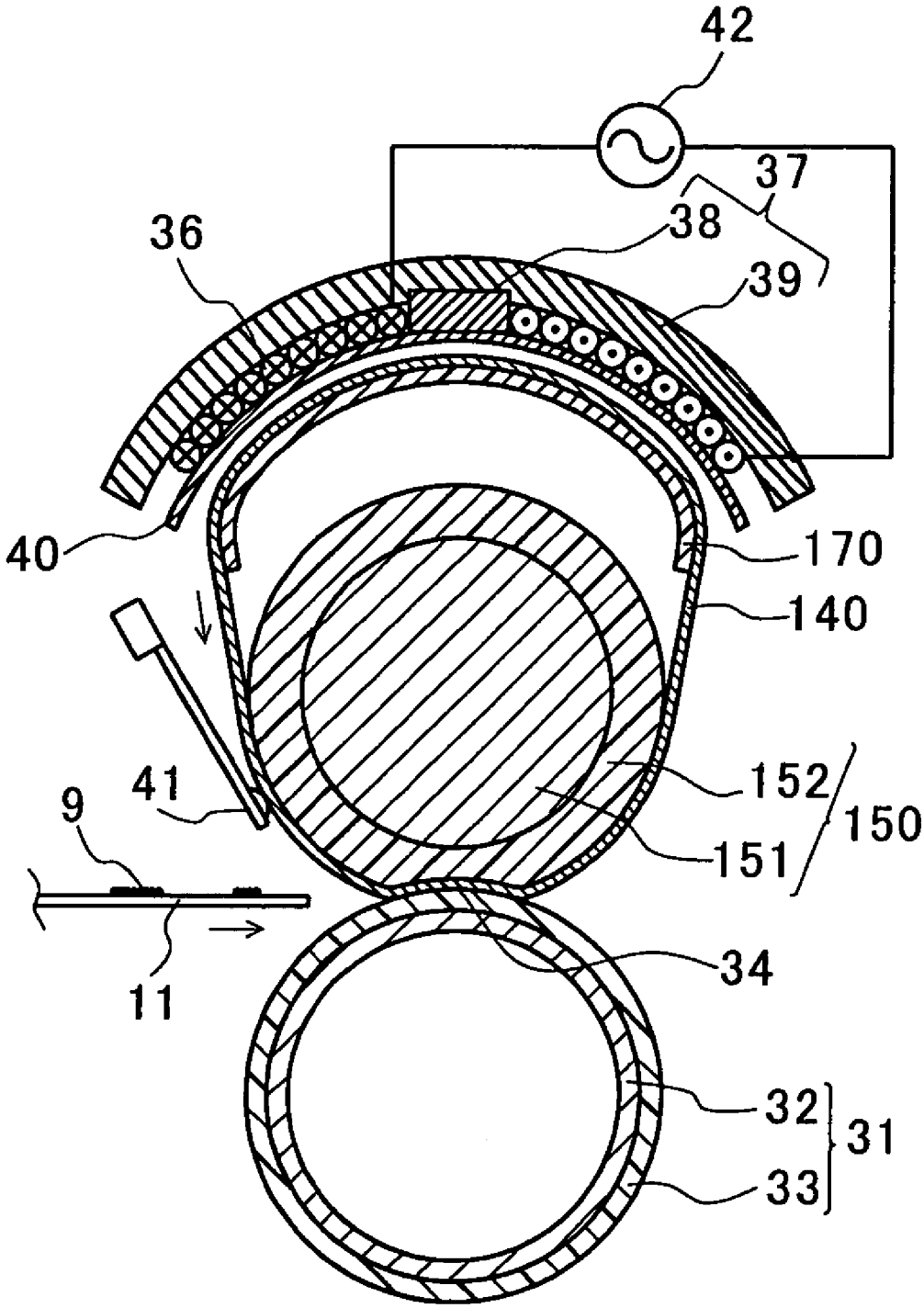
FIG. 13 is a cross sectional view of an image heating device according to Embodiment II-2 of the present invention.
Figure 14:
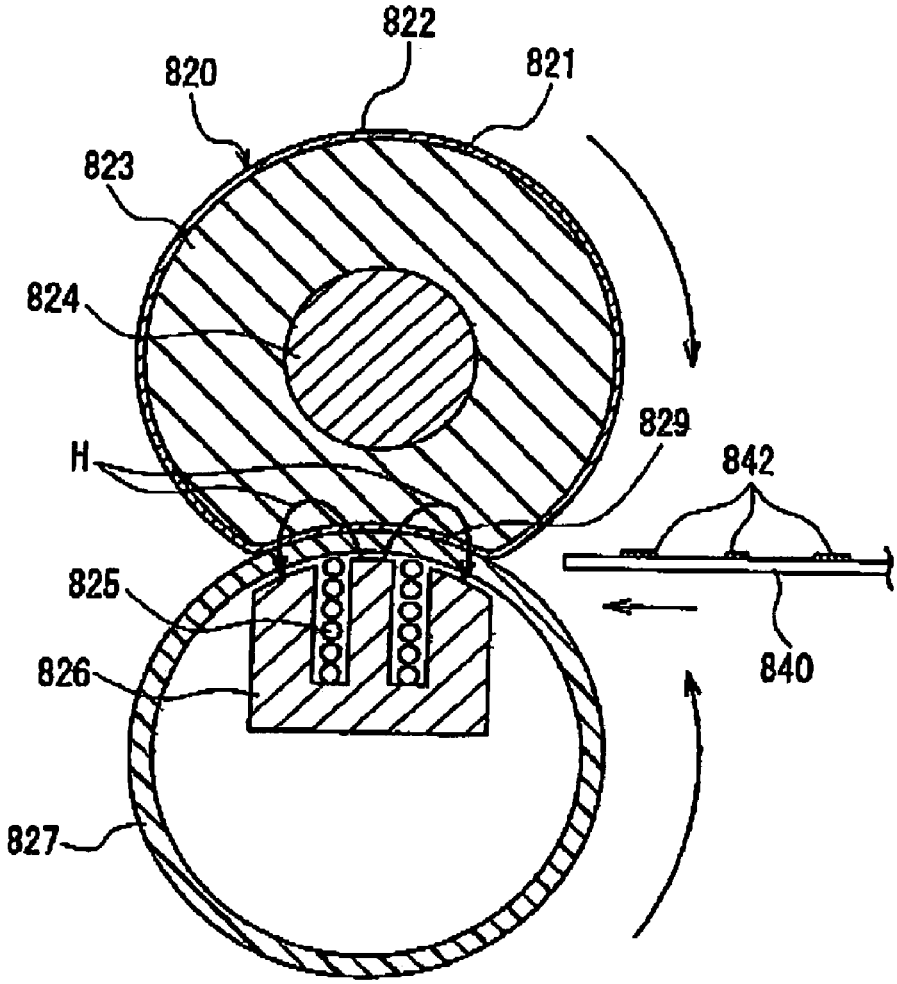
FIG. 14 Prior Art
FIG. 14 is a cross sectional view schematically showing a configuration of a conventional image heating device including a heating roller that is heated by electromagnetic induction.
Figure 15:
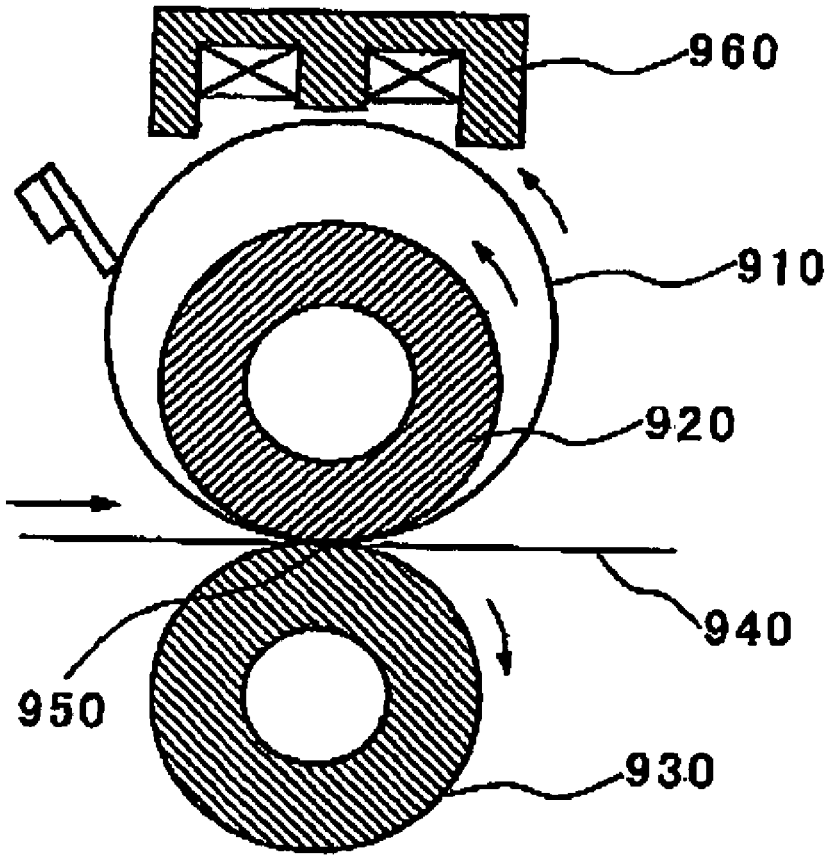
FIG.15 Prior Art
FIG. 15 is a cross sectional view schematically showing a configuration of a conventional image heating device including a heating belt that is heated by electromagnetic induction.

FIG. 13 is cross sectional view of a fixing device as the image heating device according to Embodiment II-2. In this embodiment, like reference characters indicate like members that have the same configurations and perform the same functions as those of the image heating device described with regard to Embodiment I-1, for which duplicate descriptions are omitted. In this embodiment, an excitation unit including an excitation coil 36 and a rear core 37, a heat insulating member 40 and a pressing roller 31 have the same configurations as those described with regard to Embodiment I-1. Further, a heating belt 140 and a supporting roller 150 are the same as those described with regard to Embodiment II-1.

This embodiment is different from Embodiment II-1 in that the heating belt 140 is suspended rotatably between the supporting roller 150 and a belt guide 170, and that the supporting roller 150 is in contact under pressure with the pressing roller 31 through the heating belt 140. The belt guide 170 is formed of, for example, a resin material having an excellent sliding property.

According to Embodiment II-2, as in Embodiment II-1, alternating magnetic flux from the excitation unit causes eddy current to be generated in a heat generating layer of the heating belt 140 so as to cause the heat generating layer to generate heat by induction heating. The heating belt 140, which has been caused to generate heat, heats a recording material 11 and a toner image 9 formed on the recording material 11 at a nip part 34, so that the toner image 9 is fixed on the recording material 11.

Even in the case where leaking magnetic flux that has penetrated the heat generating layer of the heating belt 140 penetrates the belt guide 170 and reaches the supporting roller 150, since a supporting layer 151 has a specific resistance of $1 \times 10^{-5}$ Ωm or higher, the supporting layer 151 is prevented from being heated.

In the example, while being driven to rotate, an image heating device having the above-mentioned configuration was supplied with a power of 800 W at 25 kHz so that warming up was started from room temperature. Monitoring of the output of a temperature detecting sensor 41 showed that the temperature of a surface of the heating belt 140 reached 170 degrees centigrade after a lapse of about 18 seconds from a start of the power supply. Further, no heat was generated in the supporting layer 151 of the supporting roller 150, and thus breakage was not caused in bearings of the supporting roller 150 or the like.

As the heat generating layer of the heating belt 140 according to this embodiment, the configurations of the heat generating layer 22 of the heating roller 21 described above with regard to Embodiments I-1 to I-4 can be used. According to the configurations, the same effects as those of Embodiments 1-1 to I-4 can be attained.

Furthermore, as the supporting layer 151 and the heat insulating layer 152 of the supporting roller 150 according to this embodiment, the configurations of the supporting layer 24 and the heat insulating layer 23 of the heating roller 21 described above with regard to Embodiments I-1 to I-4 can be used. According to the configurations, the same effects as those of Embodiments I-1 to I-4 can be attained.

In each of Embodiments II-1 to II-2 described above, a configuration was shown as an example in which the excitation unit was composed of the saddle-shaped excitation coil 36 and the rear core 37. However, the excitation unit according to the present invention is not limited thereto as long as an alternating magnetic field can be generated. Further, a configuration was shown as an example in which the pressing unit was formed of the rotatable pressing roller 31. However, the pressing unit according to the present invention is not limited thereto. For example, a pressing guide that is locked in a position while being in contact under pressure with the heating belt 140 also may be used.

The embodiments disclosed in this application are intended to illustrate the technical aspects of the invention and not to limit the invention thereto. The invention may be embodied in other forms without departing from the spirit and the scope of the invention as indicated by the appended claims and is to be broadly construed.

The invention claimed is:

1. A heating roller comprising a heat generating layer that generates heat by electromagnetic induction, a heat insulating layer, and a supporting layer, which are provided inwardly in this order, wherein the heat generating layer has a thickness smaller than a skin depth of an induction current, and the supporting layer contains a material having a specific resistance of $1 \times 10^{-5}$ Ωm or higher.

2. The beating roller according to claim 1, wherein the heat generating layer is formed of a magnetic material and has a thickness of 1 to 80 μm.

3. The heating roller according to claim 1, wherein the heat generating layer is formed of a non-magnetic material and has a thickness of 1 to 20 μm.

4. The heating roller according to claim 1, wherein the heat insulating layer is formed of a farmed elastic body having a thermal conductivity of not more than 0.9 W/m·K.

5. The heating roller according to claim 1, wherein the supporting layer is formed from ceramics.

6. The heating roller according to claim 1, wherein the supporting layer is formed of a material containing at least an oxide magnetic body.

7. The heating roller according to claim 1, wherein the supporting layer is composed of a rotary shaft and a shielding layer formed on a surface of the rotary shaft, and the shielding layer is formed of a material containing at least an oxide magnetic body.

8. The heating roller according to claim 7, wherein the rotary shaft is formed from a metal having a specific resistance of $3 \times 10^{-6}$ Ωm or lower.

9. The heating roller according to claim 7, wherein the rotary shaft is formed from a non-magnetic metal.

10. The heating roller according to claim 1, wherein the supporting layer has a diameter that is the largest at a center portion in a longitudinal direction and decreases gradually in directions toward both ends.

11. An image heating device, comprising:

a heating roller as claimed in claim 1;

an excitation unit that heats the beat generating layer by external excitation; and a pressing unit that makes contact under pressure with the heating roller to form a nip part, wherein a recording material carrying an image is passed through the nip part so that the image is fixed thermally.

12. An image forming apparatus comprising an image forming unit in which an unfixed image is formed on a recording material and carried by the recording material and an image heating device that thermally fixes the unfixed image on the recording material, wherein the image heating device is an image heating device as claimed in claim 11.

* * * * *

UNITED STATES PATENT AND TRADEMARK OFFICE

CERTIFICATE OF CORRECTION

PATENT NO. : 7,122,768 B2
APPLICATION NO. : 10/472410
DATED : October 17, 2006
INVENTOR(S) : Imai et al.

It is certified that error appears in the above-identified patent and that said Letters Patent is hereby corrected as shown below:

First page, column 1, line 2 of the Title: "HEATING APPARATUS" should read --HEATING DEVICE--.
Column 1, line 2: "HEATING APPARATUS" should read --HEATING DEVICE--.
Column 26, line 35(claim 2): "beating" should read --heating--.
Column 26, line 42(claim 4): "farmed" should read --formed--.
Column 27, line 1(claim 11): "beat" should read --heat--.

Signed and Sealed this

Fifteenth Day of May, 2007

JON W. DUDAS
*Director of the United States Patent and Trademark Office*